US010705463B2

(12) United States Patent
Watanabe

(10) Patent No.: US 10,705,463 B2
(45) Date of Patent: Jul. 7, 2020

(54) IMAGE FORMING APPARATUS CAPABLE OF TRANSPORTING JAMMED RECORDING MEDIUM

(71) Applicant: FUJI XEROX CO., LTD., Tokyo (JP)

(72) Inventor: Kanji Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/283,843

(22) Filed: Feb. 25, 2019

(65) Prior Publication Data

US 2020/0096914 A1 Mar. 26, 2020

(30) Foreign Application Priority Data

Sep. 26, 2018 (JP) ..... 2018-180676

(51) Int. Cl.
*G03G 15/00* (2006.01)
*G03G 15/16* (2006.01)

(52) U.S. Cl.
CPC ..... *G03G 15/5012* (2013.01); *G03G 15/1615* (2013.01); *G03G 15/6514* (2013.01); *G03G 15/70* (2013.01); *G03G 2215/00468* (2013.01); *G03G 2215/00552* (2013.01)

(58) Field of Classification Search
CPC ..... G03G 15/1615; G03G 15/5012; G03G 15/6514; G03G 15/6588; G03G 15/70; G03G 2215/00468; G03G 2215/00552; G03G 2215/00548
USPC ..... 399/21, 308, 392
See application file for complete search history.

(56) References Cited

U.S. PATENT DOCUMENTS

| | | | | |
|---|---|---|---|---|
| 9,581,927 | B2 * | 2/2017 | Iwakawa | G03G 15/0189 |
| 9,625,867 | B2 * | 4/2017 | Fukai | G03G 15/70 |
| 2008/0145122 | A1 * | 6/2008 | Kaneko | G03G 21/1633 399/388 |
| 2011/0210502 | A1 * | 9/2011 | Fujita | B65H 5/062 271/258.01 |
| 2015/0277334 | A1 * | 10/2015 | Matsuo | G03G 15/70 399/21 |
| 2019/0129349 | A1 * | 5/2019 | Nakabayashi | G03G 15/70 |

FOREIGN PATENT DOCUMENTS

| | | | |
|---|---|---|---|
| JP | 2004045999 | A * | 2/2004 |
| JP | 2004258375 | A * | 9/2004 |
| JP | 2008254868 | | 10/2008 |
| JP | 2011028212 | A * | 2/2011 |
| JP | 2014186077 | A * | 10/2014 |
| JP | 2016148813 | | 8/2016 |

* cited by examiner

*Primary Examiner* — Robert B Beatty
(74) *Attorney, Agent, or Firm* — JCIPRNET

(57) ABSTRACT

An image forming apparatus includes plural first transfer units, a second transfer unit, a first transport unit, and a drive unit. The first transfer units transfer an image formed on plural image holding units to an intermediate transfer unit. The second transfer unit transfers the image, which is transferred to the intermediate transfer unit, to a recording medium. The first transport unit transports the recording medium to the second transfer unit. The drive unit drives the intermediate transfer unit with at least some of the plural first transfer units separated from the intermediate transfer unit and with the second transfer unit contacting the intermediate transfer unit when the recording medium, which has been subjected to a transport failure, is transported to a feeding position by the first transport unit.

14 Claims, 21 Drawing Sheets

IMAGE FORMING APPARATUS CAPABLE OF TRANSPORTING JAMMED RECORDING MEDIUM

CROSS-REFERENCE TO RELATED APPLICATIONS

This application is based on and claims priority under 35 USC 119 from Japanese Patent Application No. 2018-180676 filed Sep. 26, 2018.

BACKGROUND

(i) Technical Field

The present disclosure relates to an image forming apparatus.

(ii) Related Art

There has hitherto been an image forming apparatus that is capable of forming an image on long-length recording paper fed from a manual feed tray or the like. Japanese Unexamined Patent Application Publication No. 2008-254868 and Japanese Unexamined Patent Application Publication No. 2016-148813, for example, disclose a technique of processing jamming of long-length recording paper caused in such an image forming apparatus.

Japanese Unexamined Patent Application Publication No. 2008-254868 describes an image forming apparatus that forms an image on paper fed from a paper feed mechanism, fixes the image which is formed on the paper using a fixing unit, and ejects'the paper. The image forming apparatus includes a transport roller, a fixing roller, a paper ejection roller, a reception unit, a detection unit, a comparison unit, an informing unit, a determination unit, a jam processing control unit, a misprint processing control unit, and a switching unit. The transport roller transports the paper which is fed from the paper feed mechanism. The fixing roller transports the paper in the fixing unit. The paper ejection roller ejects the paper. The reception unit receives information for image formation. The detection unit detects the size of the paper to be transported. The comparison unit compares paper size information detected by the detection unit and paper size information received by the reception unit. The informing unit provides information on the result of the comparison performed by the comparison unit. The determination unit determines whether the paper to be transported is long-length paper. The jam processing control unit performs control so as to stop or continue paper transport in accordance with detection of a transport failure of the paper. The misprint processing control unit performs control so as to suspend image forming operation in the case where a mismatch between the paper sizes is detected as a result of the comparison performed by the comparison unit. The switching unit switches the jam processing control unit and the misprint processing control unit. In the case where it is determined by the determination unit that the paper to be transported is long-length paper and a transport failure of the paper is detected, the switching unit switches the jam processing control unit to a long-length paper jam processing control unit that transports the long-length paper to a position at which the rear end of the paper is at a predetermined position. In the case where a mismatch between the paper sizes is detected, the switching unit switches the misprint processing control unit to a long-length paper misprint processing control unit that transports the paper to a predetermined position and stops drive.

Japanese Unexamined Patent Application Publication No. 2016-148813 describes an image forming apparatus that includes a paper transport portion, an image forming portion, a paper transport unit, and paper cutting portions. The paper transport portion transports long-length paper along a paper passage. The image forming portion forms an image on the long-length paper which is transported by the paper transport portion. The paper transport unit includes a part of the paper transport portion, and is removably attached to a body portion of the image forming apparatus. The paper cutting portions are disposed upstream and downstream of the paper transport unit in the paper transport direction, and cut the long-length paper which extends in the paper passage in the paper width direction. The paper cutting portions cut the long-length paper in conjunction with operation to draw out the paper transport unit.

SUMMARY

Aspects of non-limiting embodiments of the present disclosure relate to facilitating transport of a recording medium that has been subjected to a transport failure to a feeding position compared to a case where an intermediate transfer unit is not rotationally driven.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a plurality of first transfer units that transfer an image formed on a plurality of image holding units to an intermediate transfer unit; a second transfer unit that transfers the image, which is transferred to the intermediate transfer unit, to a recording medium; a first transport unit that transports the recording medium to the second transfer unit; and a drive unit that drives the intermediate transfer unit with at least some of the plurality of first transfer units separated from the intermediate transfer unit and with the second transfer unit contacting the intermediate transfer unit when the recording medium, which has been subjected to a transport failure, is transported to a feeding position by the first transport unit.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings.

First Exemplary Embodiment

Figure 1:
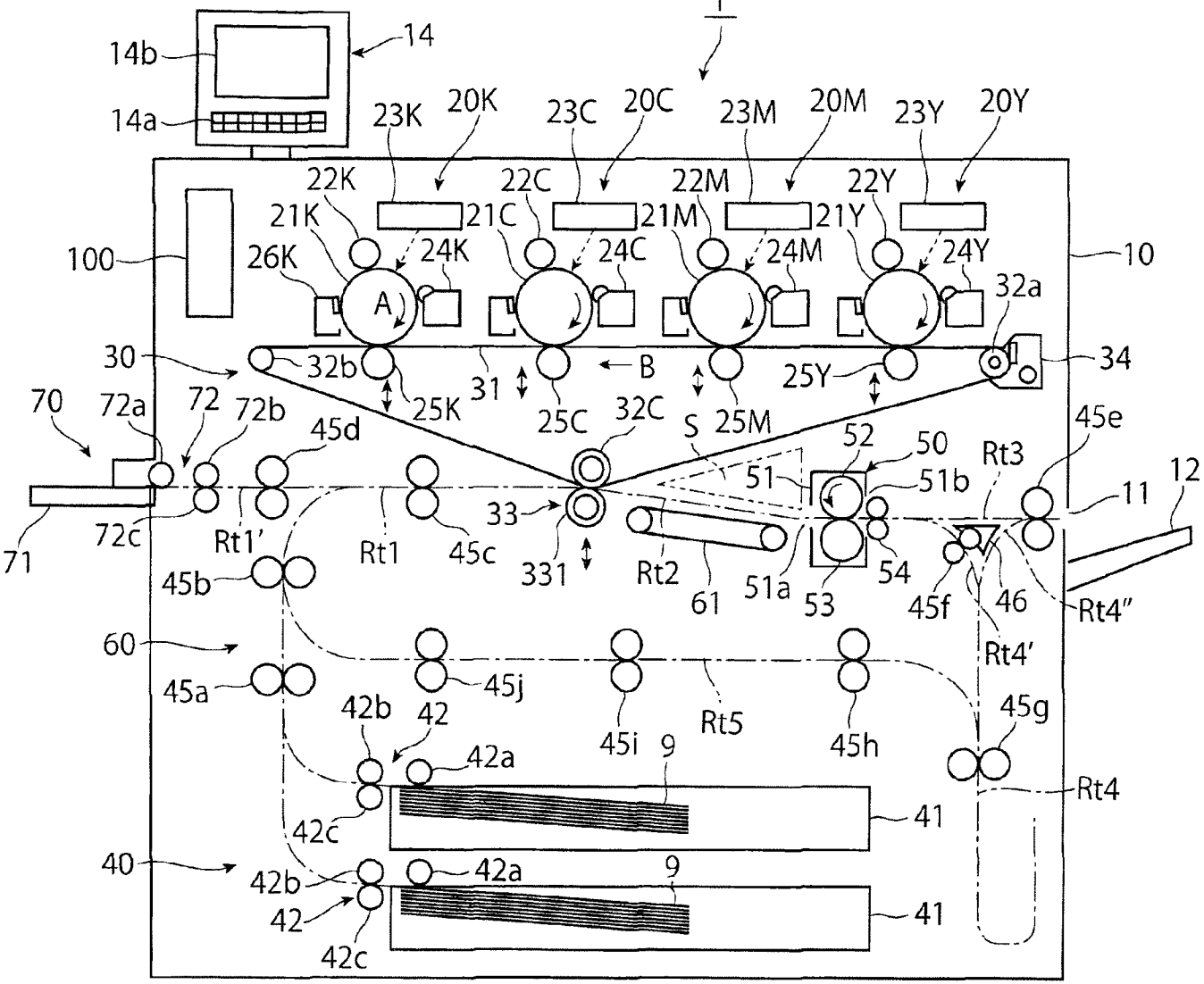
FIG. 1 is a schematic diagram illustrating an image forming apparatus according to a first exemplary embodiment of the present disclosure.
Figure 2:
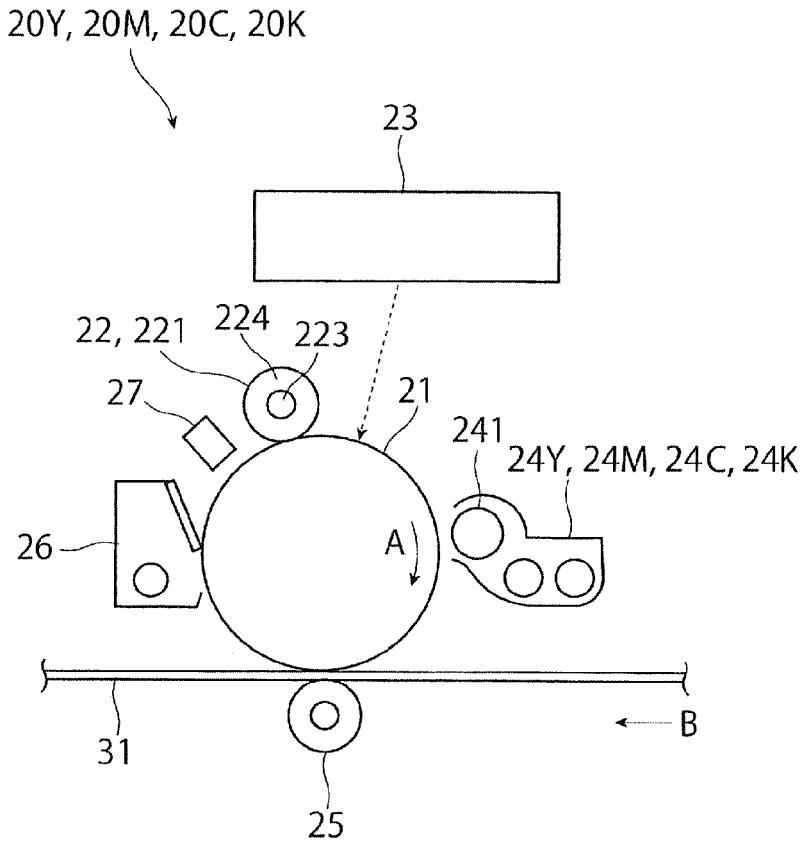
FIG. 2 illustrates the configuration of an image forming portion of the image forming apparatus according to the first exemplary embodiment of the present disclosure.

FIGS. 1 and 2 illustrate an image forming apparatus according to a first exemplary embodiment. FIG. 1 illustrates an overview of the entire image forming apparatus. FIG. 2 illustrates a part (such as image preparing devices) of the image forming apparatus as enlarged.

<Overall Configuration of Image Forming Apparatus>

An image forming apparatus 1 is a full-color printer that adopts an electrophotographic system and that finally forms an image constituted of toners on recording paper 9, which is an example of a recording medium, on the basis of image information such as characters, photographs, and figures. As illustrated in FIG. 1, the image forming apparatus 1 includes an apparatus body 10 that has a box-like appearance as a whole. The image forming apparatus 1 includes image preparing devices 20, an intermediate transfer device 30, a paper feed device 40, a fixing device 50, a paper transport device 60, etc., which are disposed inside the apparatus body 10. The image preparing devices 20 form toner images using toners as developers. The intermediate transfer device 30 holds the toner images which are formed by the image preparing devices 20 through a first transfer, and thereafter transports the toner images to a second transfer position at which the toner images are transferred to recording paper 9 through a second transfer. The paper feed device 40 stores the recording paper 9 to be supplied to the second transfer position of the intermediate transfer device 30. The fixing device 50 fixes the toner images, which are transferred by the intermediate transfer device 30 through the second transfer, to the recording paper 9. The paper transport device 60 transports the recording paper 9, which is supplied from the paper feed device 40 etc., along a prescribed transport path. The apparatus body 10 includes a support structure portion and an exterior portion formed using materials such as support members and exterior materials, for example. The dot-and-dash line indicated in FIG. 1 indicates the principal transport path for the recording paper 9 inside the apparatus body 10.

In addition, an operation display device 14, a control device 100, etc. are disposed in the image forming apparatus 1. The operation display device 14 serves as an example of an information providing unit that includes an input portion 14*a* that is used to input commands, conditions, etc. related to operation of the image forming apparatus 1, and a display portion 14*b* that displays various information such as conditions, states, etc. for the operation. The control device 100 comprehensively controls operation of the entire image forming apparatus 1 (such as the devices described above).

The image preparing devices 20 are composed of four image preparing devices 20Y, 20M, 20C, and 20K that individually form developer (toner) images in four colors, namely yellow (Y), magenta (M), cyan (C), and black (K), respectively. As illustrated in FIGS. 1 and 2, the image preparing devices 20 (Y, M, C, K) each include a photosensitive drum 21 that serves as an example of an image holding unit. A charging device 22, an exposure device 23, a developing device 24, a first transfer device 25, a drum cleaning device 26, a static eliminator 27 (see FIG. 2), etc. are disposed around the photosensitive drum 21.

The photosensitive drum 21 is a drum-shaped photoconductor in which an image forming surface (range in which an image may be formed) that has a photodielectric layer (photosensitive layer) made of a photosensitive material is formed on the peripheral surface of a grounded cylindrical or columnar conductive base material, for example. The photosensitive drum 21 is provided so as to be rotationally driven in the direction indicated by the arrow A upon receiving power from a drive device (not illustrated).

The charging device 22 is a contact charging device that includes a charging roller 221 disposed in contact with the image forming surface of the photosensitive drum 21 to be rotated in the following manner and supplied with a prescribed charging bias with minus polarity, for example. As illustrated in FIG. 2, the charging roller 221 is constituted by coating the outer periphery of a rotary shaft 223 made of metal in a columnar shape with a conductive elastic body layer 224. The charging device 22 is not limited to a contact charging device, and may be a non-contact charging device such as a scorotron.

The exposure device 23 is a non-scanning exposure device constituted using a light emitting diode, an optical component, etc., or a scanning exposure device constituted using semiconductor laser and an optical component such as a polygon mirror, for example. The exposure device 23 receives an image signal obtained by decomposing image information input from the outside through a communication unit, an image reading device, etc., or image information stored in an internal storage portion, into components for various colors (Y, M, C, K) after being subjected to prescribed processing performed by an image processing device (not illustrated). The exposure device 23 performs light exposure in accordance with the input image signal.

The developing device 24 is a developing device 24 (Y, M, C, K) that uses a two-part developer that contains a toner in one of the four colors (Y, M, C, K) and a magnetic carrier, for example. In addition, the developing device 24 (Y, M, C, K) is used to perform reversal development by charging the toner with minus polarity, for example. As illustrated in FIG. 2, further, the developing device 24 (Y, M, C, K) includes a developing roller 241 etc. that serves as an example of a developer holding unit that holds a two-part developer contained in a housing and that rotates to transport the two-part developer to a developing region that faces the photosensitive drum 21. A developing bias in which an alternating-current (AC) component is superposed on a direct-current (DC) component is supplied between the developing roller 241 and the photosensitive drum 21.

The first transfer device 25 is a contact first transfer device that serves as an example of a first transfer unit that includes a first transfer roller disposed in contact with an image forming surface portion of the photosensitive drum 21, which is a first transfer position, (via an intermediate transfer belt 31 to be discussed later) to be rotated in the following manner, and supplied with a prescribed first transfer bias, for example. The first transfer device 25 is movable by a contacting/separating unit (not illustrated) along the direction of contact with and separation from the photosensitive drum 21 at a prescribed timing.

The drum cleaning device 26 includes a cleaning member etc. such as an elastic plate disposed in an opening for cleaning work of a housing so as to contact an image forming surface portion of the photosensitive drum 21 at least after the first transfer, in order to scrape and remove unwanted matter such as a residual toner on the image forming surface.

The static eliminator 27 brings surface potential to substantially zero by eliminating static from the image forming surface of the photosensitive drum 21 through light exposure or the like, for example.

The intermediate transfer device 30 is disposed at a position below the four image preparing devices 20 (Y, M, C, K). The intermediate transfer device 30 includes an intermediate transfer belt 31 that serves as an example of an intermediate transfer unit disposed so as to be rotated in the direction indicated by the arrow B while passing through the first transfer position at which the photosensitive drum 21 faces the first transfer device 25 in the image preparing device 20 (Y, M, C, K).

The intermediate transfer belt 31 is formed in an endless belt shape with a prescribed thickness and an electrical resistance value using a material obtained by dispersing a resistance adjusting agent such as carbon in a base material such as a polyimide resin or a polyamide resin.

The intermediate transfer belt 31 is rotatably supported as wound around a plurality of support rollers 32*a* to 32*c*. The support roller 32*a* serves as a drive roller. The support roller 32*b* serves as a driven roller that holds a first transfer surface of the intermediate transfer belt 31 in cooperation with the support roller 32*a*. The support roller 32*c* serves as a second transfer back-up roller.

The intermediate transfer device 30 includes a second transfer device 33, a belt cleaning device 34, etc. The second transfer device 33 serves as an example of a second transfer unit that transfers the toner images, which have been transferred onto the intermediate transfer belt 31, to the recording paper 9 through the second transfer. The belt cleaning device 34 serves as an example of a cleaning unit for the intermediate transfer device 30 that cleans the intermediate transfer belt 31 by removing unwanted matter such as a toner that remains on and adheres to an image holding surface on the outer peripheral surface of the intermediate transfer belt 31.

The second transfer device 33 may be a contact transfer device that includes a second transfer roller 331 disposed to rotate in contact with an image holding surface portion of the intermediate transfer belt 31 supported by the support roller 32*c* during normal image formation, for example. The second transfer roller 331 of the second transfer device 33 is grounded. A prescribed second transfer bias with minus polarity, which is the same as the polarity for charging the toner, is supplied from a high-voltage power source (not illustrated) to the support roller 32*c*. The second transfer roller 331 is disposed so as to be movable by a contacting/separating unit (not illustrated) along the direction of contact with and separation from the support roller 32*c* at a prescribed timing. The second transfer device 33 is not limited to one that includes only the single second transfer roller 331, and may be one that includes a second transfer belt etc. tensely stretched over a plurality of rollers including the second transfer roller.

The belt cleaning device 34 includes a cleaning member etc. such as an elastic plate disposed in an opening for cleaning work of a housing so as to contact an image holding surface portion of the intermediate transfer belt 31 at least after the second transfer, in order to scrape and remove unwanted matter such as a residual toner on the image holding surface.

The paper feed device 40 is disposed at a position below the intermediate transfer device 30. The paper feed device 40 includes storage members 41 and feeding devices 42. The storage members 41 are each attached so as to be drawn out of the apparatus body 10, and store the recording paper 9 of a desired size, type, etc. as stacked on a loading plate (not illustrated). The feeding devices 42 each feed the recording paper 9, one sheet at a time, from the corresponding storage member 41 toward a paper feed transport path. The feeding device 42 is composed of a feeding roller 42*a*, a supply roller 42*b*, and a separation roller 42*c*. The feeding roller 42*a* feeds the recording paper 9, one sheet at a time, from the storage member 41 toward the paper feed transport path. The supply roller 42*b* supplies the recording paper 9, which has been fed by the feeding roller 42*a*, toward the second transfer position. The separation roller 42*c* separates one sheet of the recording paper 9 from the rest in order to suppress transport of sheets of the recording paper 9 not contacted by the supply roller 42*b*. The number of the storage members 41 and the feeding devices 42 may be increased and decreased in accordance with the need.

The image forming apparatus 1 also includes a paper feed device 70 that is used as opened on a side surface (left side surface in the drawing) of the apparatus body 10 to supply the recording paper 9 of a desired size, type, etc. from a manual feed tray 71.

The manual paper feed device 70 includes the manual feed tray 71 and a feeding device 72. The manual feed tray 71 is attached to the left side surface of the apparatus body 10 so as to be openable and closable, and allows the recording paper 9 of a desired size, type, etc. to be stacked thereon. The feeding device 72 feeds the recording paper 9, one sheet at a time, from the manual feed tray 17 toward the paper feed transport path. The feeding device 72 is composed of a feeding roller 72*a*, a supply roller 72*b*, and a separation roller 72*c*. The feeding roller 72*a* feeds the recording paper 9, one sheet at a time, from the manual feed tray 71 toward the paper feed transport path. The supply roller 72*b* supplies the recording paper 9, which has been fed by the feeding roller 72*a*, toward the second transfer position. The separation roller 72*c* separates one sheet of the recording paper 9 from the rest in order to suppress transport of sheets of the recording paper 9 not contacted by the supply roller 72*b*. An open/close sensor (not illustrated) that detects the open/close state of the manual feed tray 71 is disposed in the apparatus body 10 of the image forming apparatus 1. When the open/close sensor (not illustrated) detects that the manual feed tray 71 is opened, the image forming apparatus 1 operates after determining that the recording paper 9 is supplied from the manual paper feed device 70, rather than the paper feed device 40.

The recording paper 9 may be any recording medium that may be transported through a transport path in the apparatus body 10 and that toner images may be transferred and fixed to. Examples of the recording paper 9 include regular paper for use for electrophotographic copiers, printers, etc., thin paper such as tracing paper, and overhead projector (OHP) sheets. In order to further improve the smoothness of the surface of an image after being fixed, the surface of the recording paper 9 is preferably as smooth as possible. For example, coated paper prepared by coating the surface of regular paper with a resin or the like, so-called cardboard with a relatively large basis weight such as art paper for printing, etc. may also be suitably used.

Figure 3A:
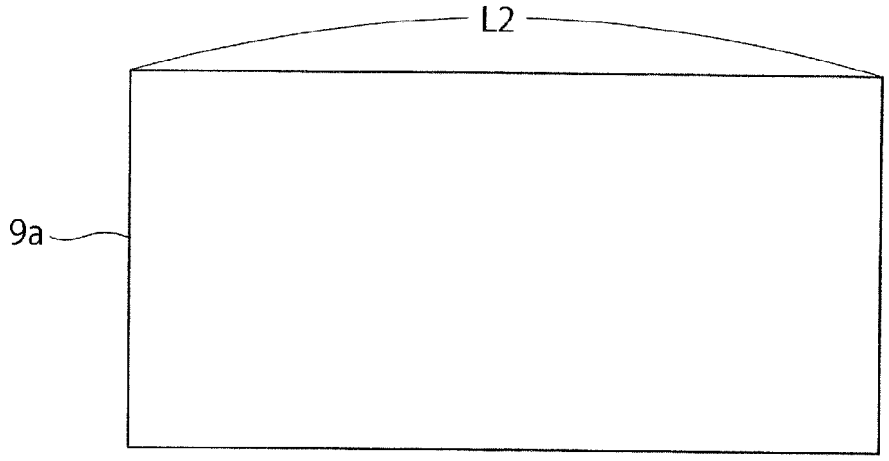
FIGS. 3A and 3B illustrate recording paper.
Figure 3B:
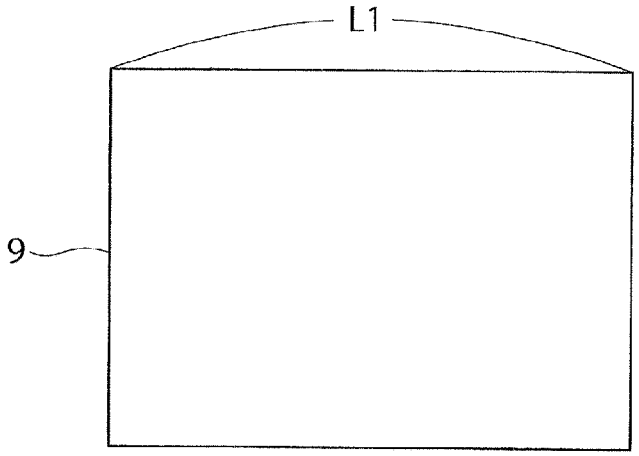

The image forming apparatus 1 also allows use of so-called long-length paper 9*a* that serves as an example of a long-length recording medium fed from the manual paper feed device 70. Examples of the long-length paper 9*a* include recording paper with a length L2 (=about 450 to 1200 mm) along the direction of transport, which is longer than a length L1 (=420 mm) of the recording paper 9 of the largest size (e.g. A3 size), of recording paper of regular sizes on which normal image formation may be performed by the image forming apparatus 1, along the direction of transport as illustrated in FIGS. 3A and 3B. Examples of the long-length paper 9*a* include recording paper of various sizes such as 210 mm×600 mm, 297 mm×900 mm, and 297 mm×1200 mm. It should be noted, however, that the long-length paper 9*a* is not limited thereto. Examples of the long-length paper 9*a* include recording paper with a length along the direction of transport that is longer than the length of recording paper of a size (e.g. A4 size), of recording paper of regular sizes on which normal image formation may be performed by the image forming apparatus 1, along the direction of transport.

The fixing device 50 is disposed downstream of the second transfer position of the intermediate transfer device 30 along the direction of transport of the recording paper 9. The fixing device 50 includes a heating rotary member 52 and a pressurizing rotary member 53 installed inside a housing 51 formed with a lead-in port 51*a* and a discharge port 51*b* for the recording paper 9. The heating rotary member 52 is in the form of a roller or a belt that rotates in the direction indicated by the arrow and that is heated by a heating unit such that the surface temperature is kept at a predetermined temperature. The pressurizing rotary member 53 is in the form of a roller or a belt that contacts the heating rotary member 52 at a predetermined pressure substantially along the axial direction of the heating rotary member 52 to be rotated in the following manner. An exit roller 54 that transports the recording paper 9 to be discharged from the housing 51 is provided at the discharge port 51*b* of the housing 51. In the fixing device 50, a portion at which the heating rotary member 52 and the pressurizing rotary member 53 contact each other is constituted as a fixation processing part to which the recording paper 9 which holds toner images is introduced to be subjected to a fixation process (heating and pressurization).

The image forming apparatus 1 includes a supply transport path Rt1, an auxiliary supply transport path Rt1', a relay transport path Rt2, a discharge transport path Rt3, a reverse transport path Rt4, and a two-sided printing transport path Rt5 provided inside the apparatus body 10 as principal paper transport paths for the recording paper 9. The supply transport path Rt1 connects between the paper feed device 40 and the intermediate transfer device 30. The auxiliary supply transport path Rt1' connects between the manual paper feed device 70 and the intermediate transfer device 30. The discharge transport path Rt3 connects between the fixing device 50 and a paper discharge port 11 of the apparatus body 10. The reverse transport path Rt4 is branched downward at the middle of the discharge transport path Rt3 to reverse the front and back sides of the recording paper 9. The two-sided printing transport path Rt5 is branched laterally at the middle of the reverse transport path Rt4 to transport the recording paper 9, the front and back sides of which have been reversed, to the supply transport path Rt1.

The paper transport device 60 transports the recording paper 9 along the supply transport path Rt1, the auxiliary supply transport path Rt1', the relay transport path Rt2, the discharge transport path Rt3, the reverse transport path Rt4, and the two-sided printing transport path Rt5.

The supply transport path Rt1 and the auxiliary supply transport path Rt1' allow the recording paper 9, which is fed from the paper feed device 40 and the manual paper feed device 70, to be transported and supplied to the second transfer position of the intermediate transfer device 30. The supply transport path Rt1 includes a plurality of paper transport roller pairs 45*a* to 45*c* etc. that transport the recording paper 9 which is fed from the paper feed device 40, and a plurality of paper guide members etc. (not illustrated). The auxiliary supply transport path Rt1' includes a paper transport roller pair 45*d* etc. that transport the recording paper 9 which is fed from the manual paper feed device 70, and a plurality of paper guide members etc. (not illustrated). The auxiliary supply transport path Rt1' is merged with the supply transport path Rt1 on the side upstream of the paper transport roller pair 45*c* along the direction of transport of the recording paper 9.

The paper transport roller pair 45*c* which is disposed at a position immediately before the second transfer position in the supply transport path Rt1 is constituted as resist rollers that serve as an example of a first transport unit that adjusts the timing to transport the recording paper 9, for example. The paper transport roller pairs 45*b* and 45*d* constitute pre-resist rollers that serve as an example of a second transport unit disposed upstream of the paper transport roller pair 45*c* along the direction of transport of the recording paper 9. The paper transport roller pairs 45*b* and 45*d*, which serve as pre-resist rollers, transport the recording paper 9 such that the distal end of the recording paper 9 contacts a nip part of the paper transport roller pair 45*c* in a stopped state. The paper transport roller pair 45*c*, which serves as resistor rollers, starts rotating in synchronization with the toner images, which are transferred onto the intermediate transfer belt 31 through the first transfer, and transports the recording paper 9 to the second transfer position of the intermediate transfer belt 31 together with the paper transport roller pairs 45*b* and 45*d*.

The relay transport path Rt2 allows the recording paper 9 after the second transfer to be transported to the fixing device 50. A transport belt 61 that transports the recording paper 9 after the second transfer is disposed on the relay transport path Rt2. The discharge transport path Rt3 allows the recording paper 9, on which an image has been formed after fixing, to be discharged from the paper discharge port 11 of the apparatus body 10 to a discharge storage portion 12 by a discharge roller pair 45*e*.

A vacant space S in a generally triangular shape as seen from the front surface is formed above the relay transport path Rt2 and upstream of the fixing device 50 along the direction of transport of the recording paper 9 between the relay transport path Rt2 and the intermediate transfer belt 31 which is disposed as being branched upward from the second transfer position of the intermediate transfer device 30. The vacant space S in a generally triangular shape as seen from the front surface functions as a feeding position to which the recording paper 9 is fed when a transport failure of the recording paper 9 as the long-length paper 9*a* is caused at a prescribed timing as discussed later. Symbol S is also used to indicate the feeding position.

The discharge transport path Rt3 is composed of the discharge roller pair 45*e* etc. and a paper guide member (not illustrated). The reverse transport path Rt4 includes a lead-in transport path Rt4' and a lead-out transport path Rt4" at the upper end portion of the reverse transport path Rt4. The lead-in transport path Rt4' is branched at the middle of the discharge transport path Rt3 to be curved downward. The lead-out transport path Rt4" is formed to be curved upward to be merged with the discharge transport path Rt3 on the side upstream of the discharge roller pair 45*e* along the direction of transport of the recording paper 9. The lead-out transport path Rt4" is used to reverse the front and back sides of the recording paper 9 to be discharged to the discharge storage portion 12 by the discharge roller pair 45*e*, for example. A switching member 46 that switches the direction of transport of the recording paper 9 to the downward direction from the discharge transport path Rt3 is disposed at the upper end portion of the reverse transport path Rt4. In addition, the lead-in transport path Rt4' is provided with a lead-in roller pair 45*f* that transports and guides the recording paper 9, the direction of transport of which has been switched to the downward direction by the switching member 46, to the reverse transport path Rt4. Further, an intermediate portion of the reverse transport path Rt4 is composed of a reverse roller pair 45*g*, the rotational direction of which is switchable between the forward direction and the reverse direction, and a paper guide member (not illustrated). The two-sided printing transport path Rt5 is composed of a plurality of two-sided printing transport roller pairs 45*h* to 45*j* etc. that transport the recording paper 9, the front and back sides of which have been reversed by the reverse transport path Rt4, to the supply transport path Rt1, and a plurality of paper guide members etc. (not illustrated).

The auxiliary supply transport path Rt1', which allows the recording paper 9 to be transported from the manual paper feed device 70 to the second transfer position of the intermediate transfer device 30, is disposed generally straight along the direction of transport of the recording paper 9 at the paper transport roller pair 45*c*.

The image forming apparatus 1 performs the basic image forming operation described below. Operation to form a full-color image by combining toner images in four colors (Y, M, C, K) will be described.

First, when the control device 100 of the image forming apparatus 1 receives a command to request image forming operation from the outside etc., the photosensitive drum 21 is rotated in the direction indicated by the arrow A in each of the four image preparing devices 20 (Y, M, C, K), and the charging device 22 is supplied with a charging current to cause contact discharge. Consequently, the image forming surface of the photosensitive drum 21 is charged with prescribed polarity (e.g. minus polarity) and prescribed potential.

Subsequently, the exposure device 23 performs light exposure on the image forming surface of the photosensitive drum 21 after being charged in accordance with an image signal decomposed into components for various colors (Y, M, C, K). Consequently, an electrostatic latent image for each color component at predetermined potential is formed on the image forming surface of the photosensitive drum 21.

Subsequently, the developing device 24 (Y, M, C, K) supplies a toner in each color (Y, M, C, K) charged with predetermined polarity (minus polarity) from the developing roller 241, and causes the toner to electrostatically adhere to an electrostatic latent image portion for each color component on the image forming surface of the photosensitive drum 21 using a developing field formed between the developing roller 241 and the photosensitive drum 21 upon receiving supply of a developing bias. Consequently, a toner image in the corresponding color, among the four colors (Y, M, C, K), is individually formed on the image forming surface of the photosensitive drum 21.

Subsequently, the first transfer device 25 is supplied with a first transfer current to form a first transfer field between the photosensitive drum 21 and the first transfer device 25, and toner images on the photosensitive drums 21 are transferred to the image holding surface of the intermediate transfer belt 3 in the intermediate transfer device 30 sequentially (in the order of Y, M, C, and K) through the first transfer. In addition, the drum cleaning device 26 cleans the image forming surface of the photosensitive drum 21 after the first transfer etc. Further, the static eliminator 27 eliminates static from the image forming surface of the photosensitive drum 21 after the first transfer etc. to prepare for the next image preparing operation to be performed on the photosensitive drum 21.

Next, in the intermediate transfer device 30, the intermediate transfer belt 31 is rotated in the direction indicated by the arrow B to transport unfixed toner images, which have been transferred to the image holding surface of the intermediate transfer belt 31 through the first transfer and are held thereon, to the second transfer position facing the second transfer device 33. In the paper feed device 40 or the manual paper feed device 70, on the other hand, the feeding device 42 or 72 feeds the prescribed recording paper 9 from the storage member 41 or the manual feed tray 71 to the supply transport path Rt1 or the auxiliary supply transport path Rt1', and thereafter supplies the recording paper 9 to be fed to the second transfer position of the intermediate transfer device 30 by way of the supply transport path Rt1 or the auxiliary supply transport path Rt1'. At the second transfer position, the second transfer device 33 forms a second transfer field between the second transfer device 33 and the intermediate transfer belt 31 upon receiving supply of a second transfer bias to transfer the toner images in the four colors on the intermediate transfer belt 31 to one side of the recording paper 9 through the second transfer.

Next, the recording paper 9, to which the unfixed toner images have been transferred through the second transfer, is peeled from the intermediate transfer belt 31, and thereafter transported to be fed to the fixing device 50 by way of the relay transport path Rt2. In the fixing device 50, the recording paper 9 is heated and pressurized when the recording paper 9 is introduced to and passes through the fixation processing part at which the heating rotary member 52 and the pressurizing rotary member 53 contact each other. Consequently, the toners which constitute the toner images are melted under pressure so that the toner images are fixed to the recording paper 9.

Subsequently, the recording paper 9 after fixation of the toner images is discharged from the inside of the housing 51 of the fixing device 50, thereafter transported by way of the discharge transport path Rt3, and finally discharged from the paper discharge port 11 to the outside of the apparatus body 10 to be stored in the discharge storage portion 12.

In the case where an image is to be formed on two surfaces of the recording paper 9, the recording paper 9, on one surface of which an image has been formed, is not discharged to the discharge storage portion 12, but the path for the recording paper 9 is switched from the discharge transport path Rt3 to the reverse transport path Rt4 by the switching member 46. The rotational direction of the reverse roller pair 45*g* of the reverse transport path Rt4 is changed from the forward direction to the reverse direction while holding the upper end of the recording paper 9 which has been transported, and the recording paper 9 is transported to the two-sided printing transport path Rt5 with the front and back sides of the recording paper 9 reversed. Toner images are transferred to the back surface of the recording paper 9, which is transported to the two-sided printing transport path Rt5, by way of the supply transport path Rt1. After that, the recording paper 9 is transported to the fixing device 50 by way of the relay transport path Rt2, subjected to a fixation process (heating and pressurization) performed by the fixing device 50, and stored in the discharge storage portion 12 by way of the discharge transport path Rt3.

One sheet of the recording paper 9, on one surface or two surfaces of which a full-color image has been formed, is output through the above operation. In the case where a command to request image forming operation for a plural number of sheets is received, the above image forming operation is performed in the same manner repeatedly for the same number of times as the number of sheets.

Besides, in the above image forming operation performed by the image forming apparatus 1, one of the four image preparing devices 20 (Y, M, C, K) may be actuated to form a monochrome image, or a combination of two or three of the four image preparing devices 20 (Y, M, C, K) may be actuated to form a color image that is not a full-color image.

Figure 4:
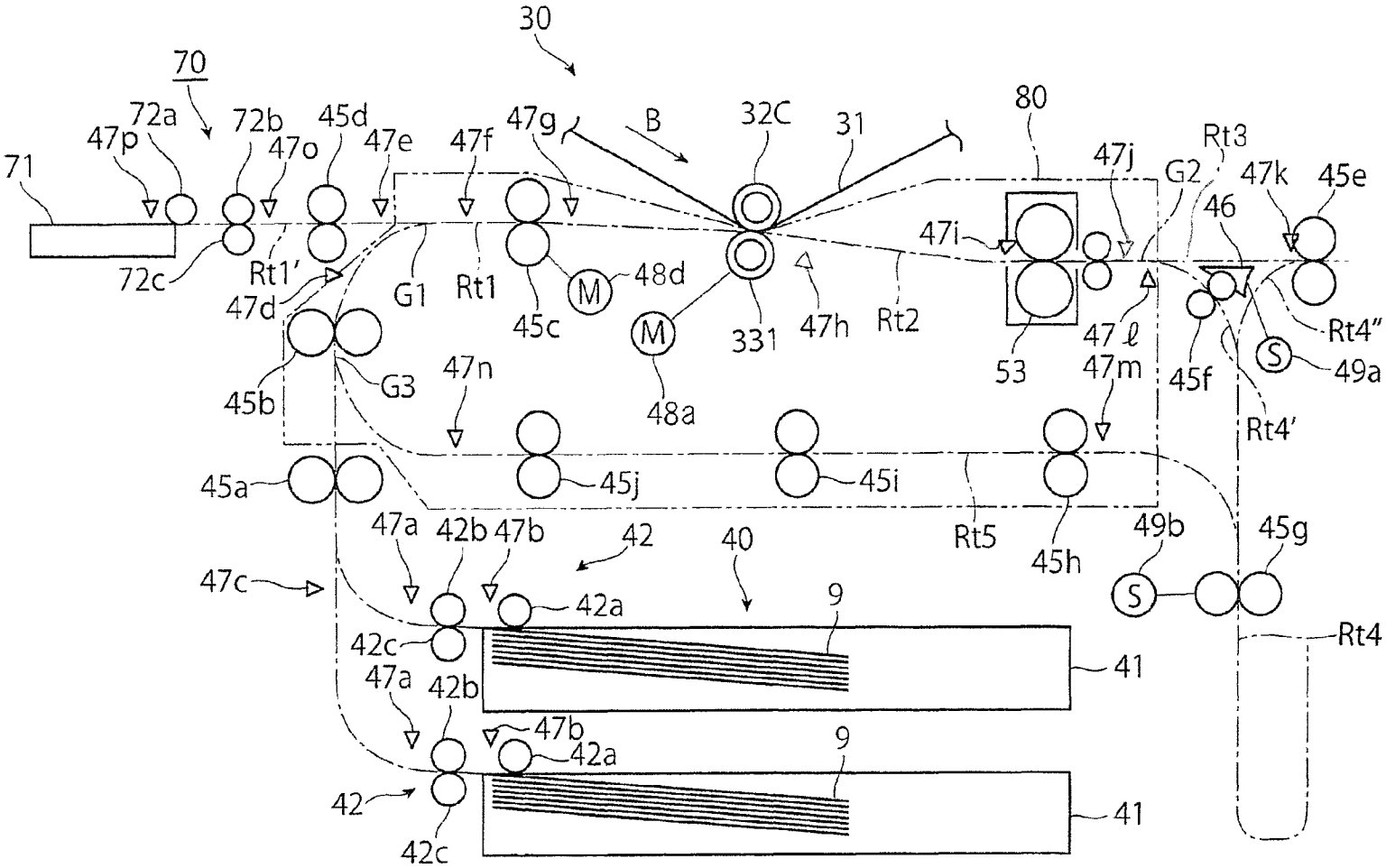
FIG. 4 illustrates the configuration of a part of the image forming apparatus according to the first exemplary embodiment of the present disclosure.

In the image forming apparatus 1 according to the first exemplary embodiment, as illustrated in FIG. 4, in the case where a transport failure (so-called jam) of the recording paper 9 such as a paper jam is caused in any of the supply transport path Rt1, the auxiliary supply transport path Rt1', the relay transport path Rt2, the discharge transport path Rt3, the reverse transport path Rt4, and the two-sided printing transport path Rt5 through which the recording paper 9 is transported, image forming operation and transport of the recording paper 9 are temporarily stopped.

The transport failure of the recording paper 9 refers to a case where the recording paper 9 is not transported adequately along the prescribed transport paths Rt1 to Rt5. More specifically, the recording paper 9 is normally transported at a prescribed transport speed along the prescribed transport paths in accordance with the size, material, etc. of the recording paper 9. Thus, the transport failure of the recording paper 9 refers to a case where the distal end and the rear end of the recording paper 9 do not reach positions at which the distal end and the rear end should be within a time in which the distal end and the rear end should reach such positions.

After that, the image forming apparatus 1 operates to display a display screen (message) that prompts the user to remove the recording paper 9, which has been subjected to the transport failure, on the display portion 14*b* of the operation display device 14, together with the procedure for removal, in accordance with the type of the recording paper 9, the location at which the transport failure is caused, etc., and transports the recording paper 9, which has been subjected to the transport failure, to a position that is suitable for removal as appropriate and as necessary.

As illustrated in FIG. 4, the image forming apparatus 1 includes a plurality of paper sensors 47*a* to 47*p* that serve as a paper detection unit that detects the transport position of the recording paper 9 during image formation. Examples of such paper sensors 47*a* to 47*p* include a reflective optical sensor that detects the presence or absence of the recording paper 9 by radiating light to the recording paper 9 and receiving light reflected by the recording paper 9. It should be noted, however, that the paper sensors 47*a* to 47*p* are not limited to a reflective optical sensor, and the paper sensors 47*a* to 47*p* may be a transmissive optical sensor or a combination of an optical sensor and an actuation member such as an actuator that is movable with inclination along with passage of the recording paper 9.

In the paper feed device 40, a first paper sensor 47*a* is disposed downstream of the supply roller 42*b* along the direction of transport of the recording paper 9. The first paper sensor 47*a* detects the distal-end position (upstream end portion) or the rear-end position (downstream end portion) of the recording paper 9. In the paper feed device 40, in addition, a second paper sensor 47*b* is provided in the vicinity of the feeding roller 42*a*. The second paper sensor 47*b* detects upward movement of the feeding roller 42*a* when the feeding roller 42*a* is moved upward to be separated from the recording paper 9 by energizing a solenoid (not illustrated). To be exact, the second paper sensor 47*b* does not detect the recording paper 9. However, the second paper sensor 47*b* is directly associated with transport of the recording paper 9, and therefore described as one of the paper sensors.

In the supply transport path Rt1, third and fourth paper sensors 47*c* and 47*d* are provided upstream of the paper transport roller pair 45*a* and downstream of the paper transport roller pair 45*b*, respectively, along the direction of transport of the recording paper 9. The third and fourth paper sensors 47*c* and 47*d* each detect the distal-end position or the rear-end position of the recording paper 9. The third paper sensor 47*c* is used to detect each of sheets of the recording paper 9 supplied from the two storage members 41.

In addition, a fifth paper sensor 47*e* is provided at a position on the side of the auxiliary supply transport path Rt1' with respect to a merging position G1, at which the supply transport path Rt1 and the auxiliary supply transport path Rt1' are merged with each other. The fifth paper sensor 47*e* detects the rear-end position of the recording paper 9. The fifth paper sensor 47*e* detects that the rear end of the recording paper 9 which is supplied from the auxiliary supply transport path Rt1' has passed through the merging position G1 between the supply transport path Rt1 and the auxiliary supply transport path Rt1'.

In addition, sixth and seventh paper sensors 47*f* and 47*g* are provided upstream and downstream, respectively, of the paper transport roller pair 45*c* which serves as resistor rollers. The sixth and seventh paper sensors 47*f* and 47*g* detect the distal-end position or the rear-end position of the recording paper 9. After a prescribed time elapses after the distal-end position of the recording paper 9 is detected by the sixth paper sensor 47*f*, rotational drive of the paper transport roller pair 45*c* is started. The distal-end position or the rear-end position of the recording paper 9 which is transported by the paper transport roller pair 45*c* is detected by the seventh paper sensor 47*g*.

In the intermediate transfer device 30, an eighth paper sensor 47*h* is provided downstream of the second transfer roller 331 along the direction of transport of the recording paper 9. The eighth paper sensor 47*h* detects the distal-end position or the rear-end position of the recording paper 9.

In the fixing device 50, ninth and tenth paper sensors 47*i* and 47*j* are provided upstream of the housing 51 and downstream of the exit roller 54, respectively. The ninth and tenth paper sensors 47*i* and 47*j* each detect the distal-end position or the rear-end position of the recording paper 9.

In the discharge transport path Rt3, an eleventh paper sensor 47*k* is disposed upstream of the discharge roller pair 45*e* along the direction of transport of the recording paper 9. The eleventh paper sensor 47*k* detects the distal-end position and the rear-end position of the recording paper 9. The eleventh paper sensor 47*k* detects that the recording paper 9 is discharged from the paper discharge port 11 (see FIG. 1) to the discharge storage portion 12 by detecting both the distal-end position and the rear-end position of the recording paper 9.

In the reverse transport path Rt4, a twelfth paper sensor 471 is provided at the entrance to the lead-in transport path Rt4' which is branched from the discharge transport path Rt3. The twelfth paper sensor 471 detects the distal-end position or the rear-end position of the recording paper 9.

In the two-sided printing transport path Rt5, thirteenth and fourteenth paper sensors 47*m* and 47*n* are provided upstream of the two-sided printing transport roller pair 45*h* and downstream of the two-sided printing transport roller pair 45*j*, respectively, along the direction of transport of the recording paper 9. The thirteenth and fourteenth paper sensors 47*m* and 47*n* each detect the recording paper 9.

In the manual paper feed device 70, meanwhile, a fifteenth paper sensor 47*o* is disposed downstream of the supply roller 72*b* along the direction of transport of the recording paper 9. The fifteenth paper sensor 47*o* detects the distal-end position or the rear-end position of the recording paper 9. In the manual paper feed device 70, in addition, a sixteenth paper sensor 47*p* is provided in the vicinity of the feeding roller 72*a*. The sixteenth paper sensor 47*p* detects upward movement of the feeding roller 72*a* when the feeding roller 72*a* is moved upward to be separated from the recording paper 9 by energizing a solenoid (not illustrated).

A switching gate 46 is provided downstream of the fixing device 50 along the direction of transport of the recording paper 9. The switching gate 46 switches the direction of transport of the recording paper 9 to the reverse transport path Rt4. The switching gate 46 is driven by a first solenoid 49*a*.

The reverse roller pair 45*g*, which is provided in the reverse transport path Rt4, is capable of releasing the nipped state of the recording paper 9 using a second solenoid 49*b*. The reverse roller pair 45*g* releases the nipped state of the recording paper 9 using the second solenoid 49*b* at the timing when the distal end of the recording paper 9 is nipped by the two-sided printing transport roller pair 45*h*.

Figure 5:
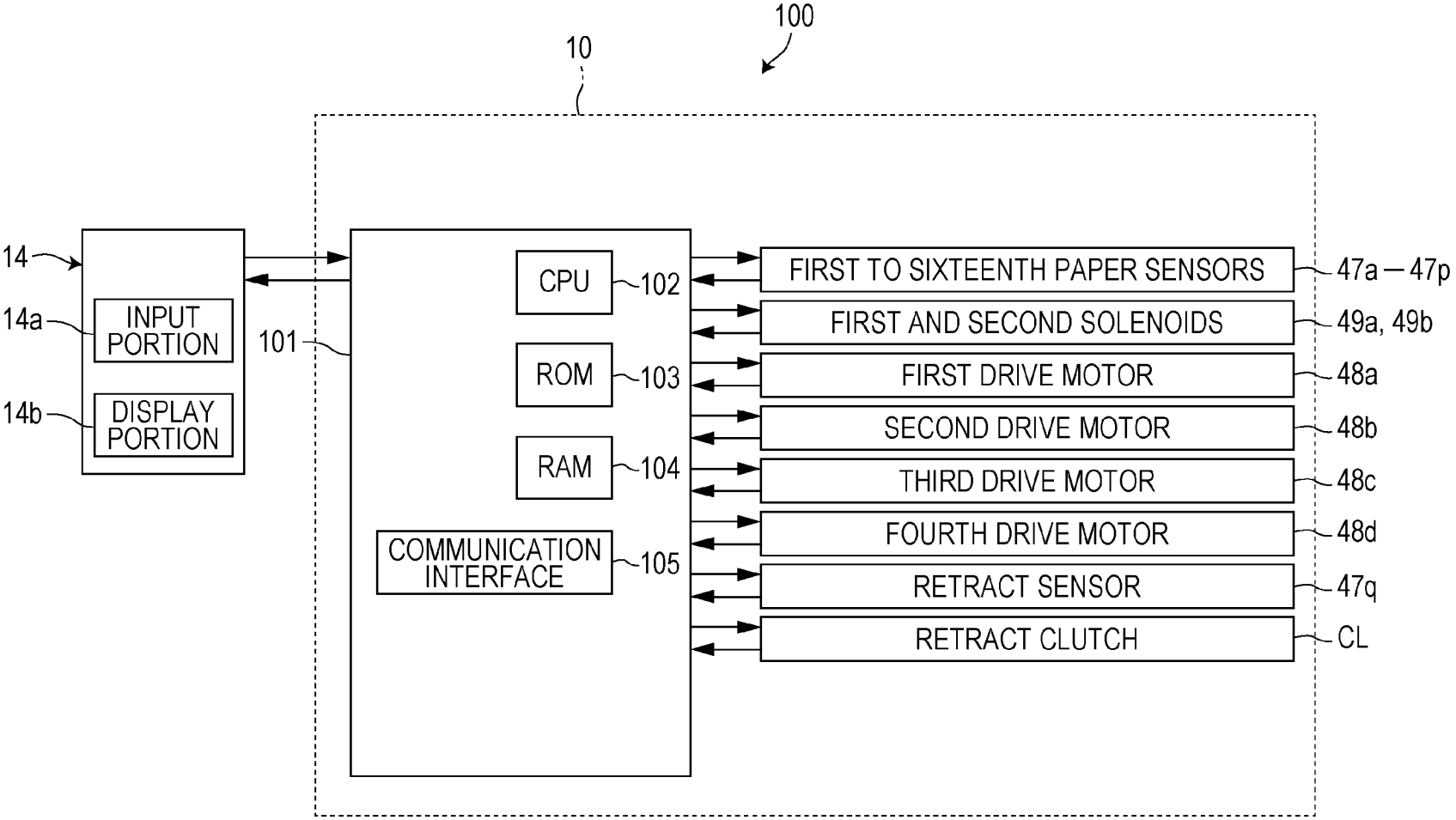
FIG. 5 is a block diagram illustrating a control device of the image forming apparatus according to the first exemplary embodiment of the present disclosure.

FIG. 5 is a block diagram illustrating the control device 100 of the image forming apparatus according to the first exemplary embodiment of the present disclosure.

In the drawing, reference numeral 101 denotes a control portion that serves as an example of a control unit of the control device 100 which comprehensively controls operation of the image forming apparatus 1. The control portion 101 includes a central processing unit (CPU) 102, a read only memory (ROM) 103, a random access memory (RAM) 104, a bus (not illustrated), a communication interface 105, etc. The CPU 102 comprehensively controls image forming operation. The ROM 103 stores a control program etc. executed by the CPU 102. The RAM 104 stores a parameter etc. for use in the control program etc. which is executed by the CPU 102. The bus connects the CPU 102, the ROM 103, etc. to each other. The communication interface 105 communicates with an external personal computer, image reading device, etc.

The control portion 101 receives, as appropriate, input of a signal that indicates detection of the recording paper 9 from the first to sixteenth paper sensors 47*a* to 47*p*. The control portion 101 also controls drive of the first and second solenoids 49*a* and 49*b* and drive motors 48*a* to 48*d* to be discussed later.

The CPU 102 includes a time measurement unit such as an internal timer that measures time. In controlling image forming operation, the CPU 102 manages the time to output a control signal, the time when a signal from the first to sixteenth paper sensors 47*a* to 47*p* is input, etc., and determines whether or not a transport failure of the recording paper 9 is caused.

The operation display device 14 is connected to the control portion 101. The control portion 101 receives various commands from the input portion 14*a* of the operation display device 14, and executes operation to display prescribed information on the display portion 14*b*.

As illustrated in FIG. 4, the image forming apparatus 1 includes a diversity of transport paths to transport the recording paper 9, namely the supply transport path Rt1, the auxiliary supply transport path Rt1', the relay transport path Rt2, the discharge transport path Rt3, the reverse transport path Rt4, and the two-sided printing transport path Rt5. Therefore, when a transport failure of the recording paper 9 is caused in any of the transport paths Rt1 to Rt5 of the image forming apparatus 1, it is occasionally difficult to remove the recording paper 9 which has been subjected to the transport failure only by opening a front cover, a side cover, or the like of the apparatus body 10.

In the exemplary embodiment, as indicated by the double-dashed line in FIG. 4, the supply transport path Rt1 which is positioned downstream of the merging position Gl, at which the supply transport path Rt1 and the auxiliary supply transport path Rt1' are merged with each other, along the direction of transport of the recording paper 9, the relay transport path Rt2, the discharge transport path Rt3 which is positioned upstream of a merging position G2, at which the discharge transport path Rt3 and the reverse transport path Rt4 are merged with each other, along the direction of transport of the recording paper 9, the two-sided printing transport path Rt5 which is branched from the reverse transport path Rt4, and the supply transport path Rt1 which is positioned downstream of the paper transport roller pair 45*a* along the direction of transport of the recording paper 9, among the transport paths for the recording paper 9, constitute a paper transport unit 80 that may be drawn out via a guide rail (not illustrated) toward the front side of the apparatus body 10 separately from the other adjacent transport paths.

Figure 6:
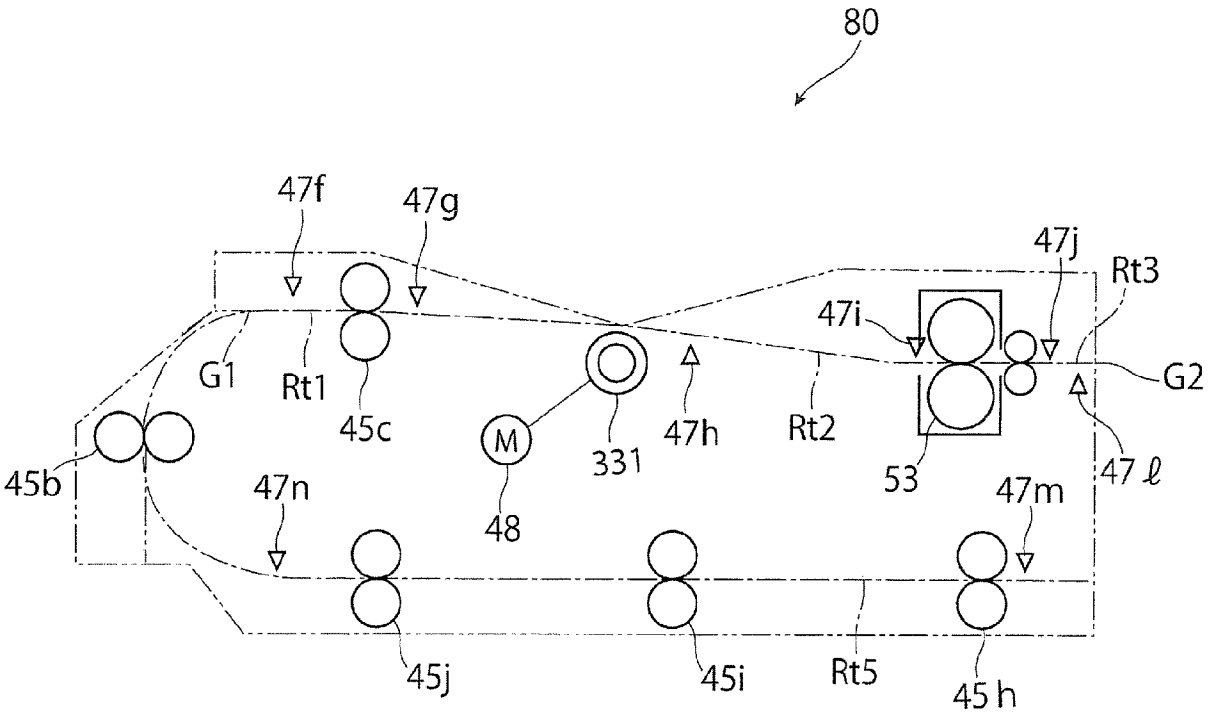
FIG. 6 illustrates the configuration of a paper transport unit.

As illustrated in FIG. 6, the paper transport roller pair 45*c*, the second transfer roller 331, the fixing device 50, the paper sensors 47*f*, 47*g*, 47*h*, 47*i*, 47*j*, 471, 47*m*, and 47*n*, etc., besides the transport paths discussed above, are mounted to the paper transport unit 80.

Figure 7A:
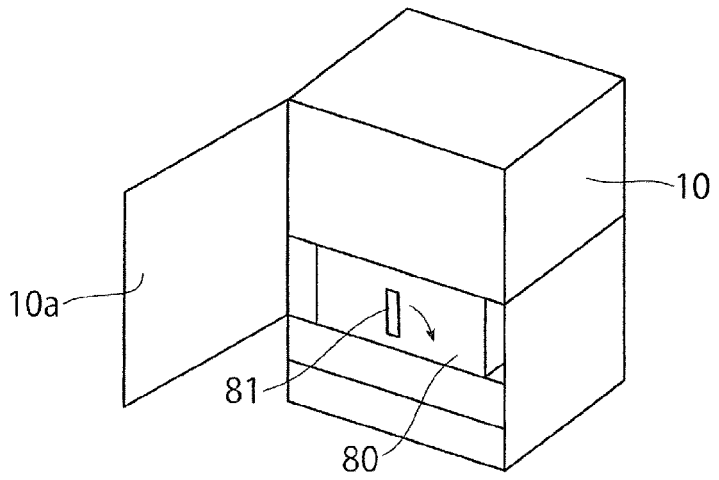
FIGS. 7A and 7B are each a perspective view illustrating the configuration of the image forming apparatus.
Figure 7B:
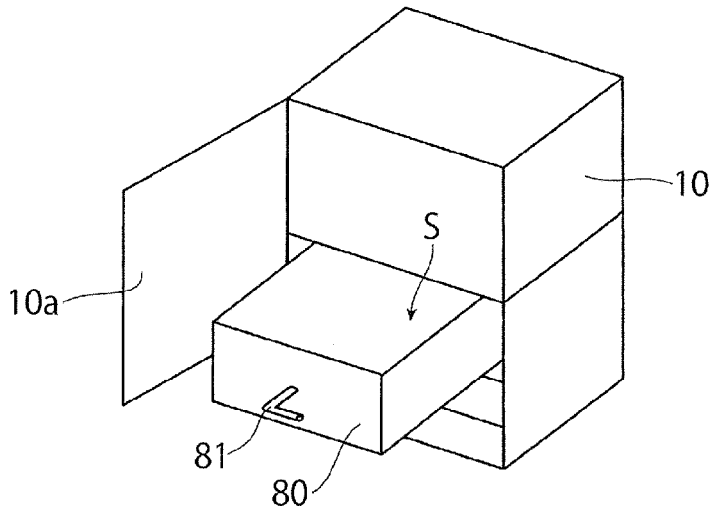

As illustrated in FIGS. 7A and 7B, the paper transport unit 80 is exposed to the outside of the apparatus body 10 by opening a front cover 10*a* of the apparatus body 10. The paper transport unit 80 may be drawn out via the guide rail (not illustrated) toward the front side of the apparatus body 10 by being unlocked with respect to the apparatus body 10 by turning an operation lever 81 by 90 degrees clockwise in the drawing. The operation lever 81 is turnably provided on the front surface of the paper transport unit 80. As illustrated in FIG. 6, by drawing out the paper transport unit 80 toward the front side of the apparatus body 10, the supply transport path Rt1 which is positioned downstream of the merging position G1, at which the supply transport path Rt1 and the auxiliary supply transport path Rt1' are merged with each other, along the direction of transport of the recording paper 9, the relay transport path Rt2, the discharge transport path Rt3 which is positioned upstream of the merging position G2, at which the discharge transport path Rt3 and the reverse transport path Rt4 are merged with each other, along the direction of transport of the recording paper 9, the two-sided printing transport path Rt5 which is branched from the reverse transport path Rt4, and the supply transport path Rt1 which is positioned downstream of the paper transport roller pair 45*a* along the direction of transport of the recording paper 9 are exposed to the outside. As illustrated in FIG. 7B, in addition, the feeding position S is exposed on the upper end surface on the right side of the paper transport unit 80 when the paper transport unit 80 is drawn out toward the front surface side of the apparatus body 10.

Figure 8:
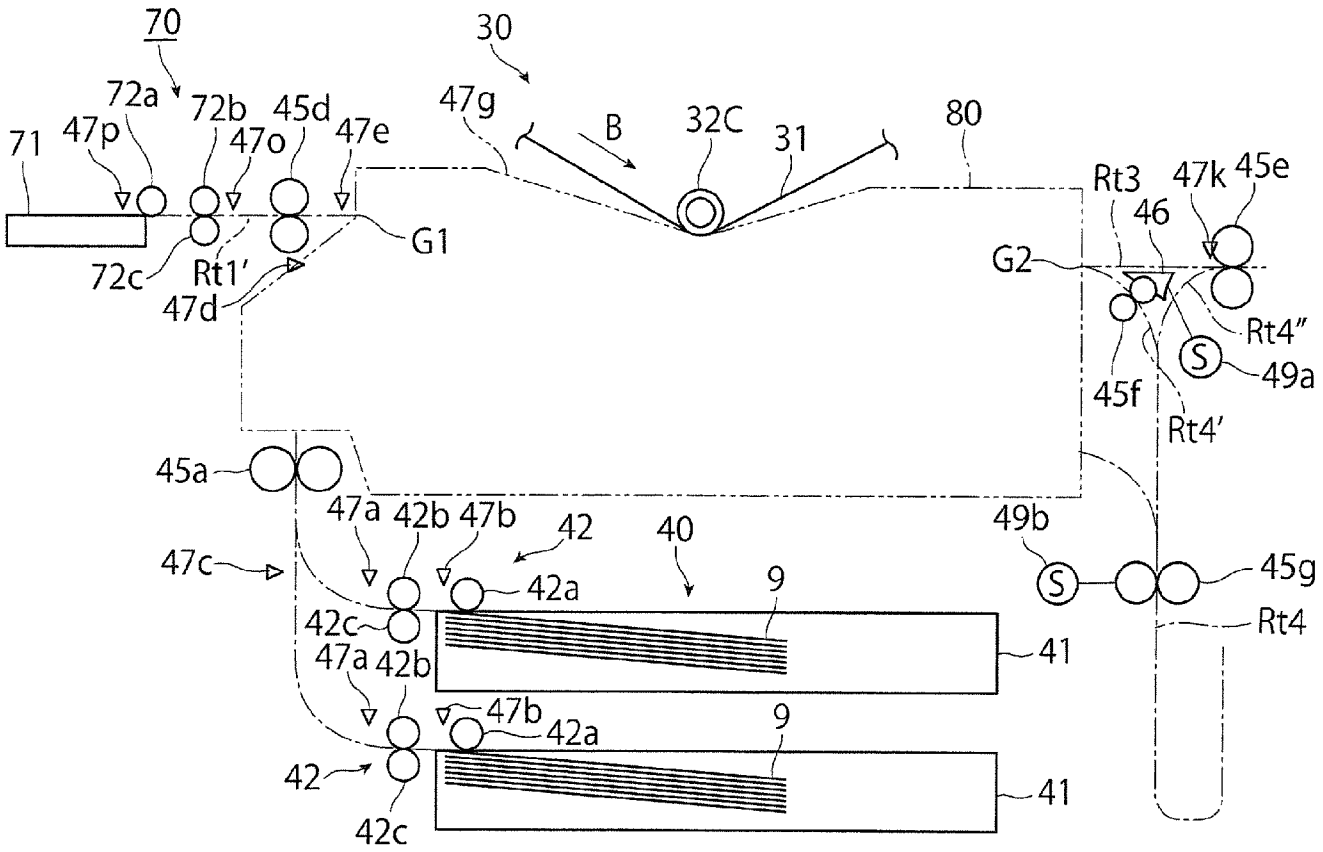
FIG. 8 illustrates the configuration of a part of the image forming apparatus with the paper transport unit drawn out.

As illustrated in FIG. 8, by drawing out the paper transport unit 80 of the image forming apparatus 1 toward the front surface side of the apparatus body 10, the transport path for the recording paper 9 is divided into an upstream portion and a downstream portion along the direction of transport of the recording paper 9 at the merging position G1 between the supply transport path Rt1 and the auxiliary supply transport path Rt1' and the merging position G2 between the discharge transport path Rt3 and the reverse transport path Rt4. Therefore, in the case where the recording paper 9 crosses the merging position G1 between the supply transport path Rt1 and the auxiliary supply transport path Rt1' or the merging position G2 between the discharge transport path Rt3 and the reverse transport path Rt4, the transport path is divided at the merging position G1 or G2 when the paper transport unit 80 is drawn out toward the front side of the apparatus body 10 as illustrated in FIG. 7B, and the recording paper 9 is torn in a so-called guillotine state.

Thus, in the exemplary embodiment, when the recording paper 9 which has been subjected to a transport failure crosses the merging position G1 between the supply transport path Rt1 and the auxiliary supply transport path Rt1' or the merging position G2 between the discharge transport path Rt3 and the reverse transport path Rt4, operation to forcibly transport the recording paper 9 toward the supply transport path Rt1 which is downstream along the direction of transport of the recording paper 9 and further toward the discharge transport path Rt3 which is downstream along the direction of transport of the recording paper 9 is executed.

Figure 9:
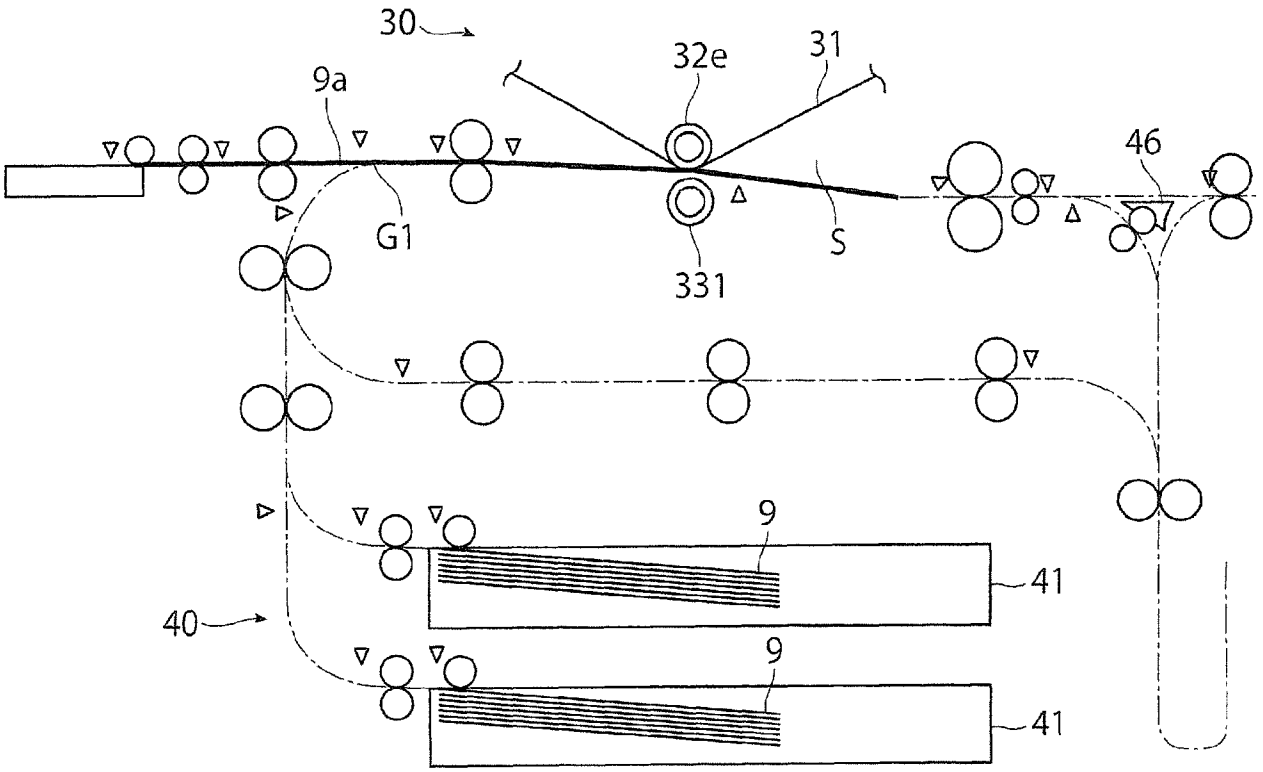
FIG. 9 illustrates a state in which a transport failure of long-length paper is caused.

In that event, as illustrated in FIG. 9, in the case where the recording paper is the long-length paper 9*a* and a transport failure of the long-length paper 9*a* is caused when the distal end of the long-length paper 9*a* has passed through the second transfer position of the intermediate transfer device 30 and is positioned upstream of the fixing device 50, operation to transport and feed the long-length paper 9*a* to the feeding position S, which is determined in advance, using the paper transport roller pair 45*c* and the paper transport roller pair 45*d* is executed.

The operation to transport and feed the long-length paper 9*a* to the feeding position S using the paper transport roller pair 45*c* and the paper transport roller pair 45*d* is performed as a part of operation to remove the long-length paper 9*a* which has been subjected to a transport failure with image forming operation and transport of the recording paper 9 temporarily stopped when a transport failure of the long-length paper 9*a* is caused.

In the case where a transport failure of the recording paper 9 including the long-length paper 9*a* is caused, image forming operation and transport of the recording paper 9 are temporarily stopped, and operation to separate the second transfer roller 331 from the support roller 32*c* of the intermediate transfer device 30 using a contacting/separating unit (not illustrated) is performed in synchronization with the stopping of the image forming operation.

Figure 10:
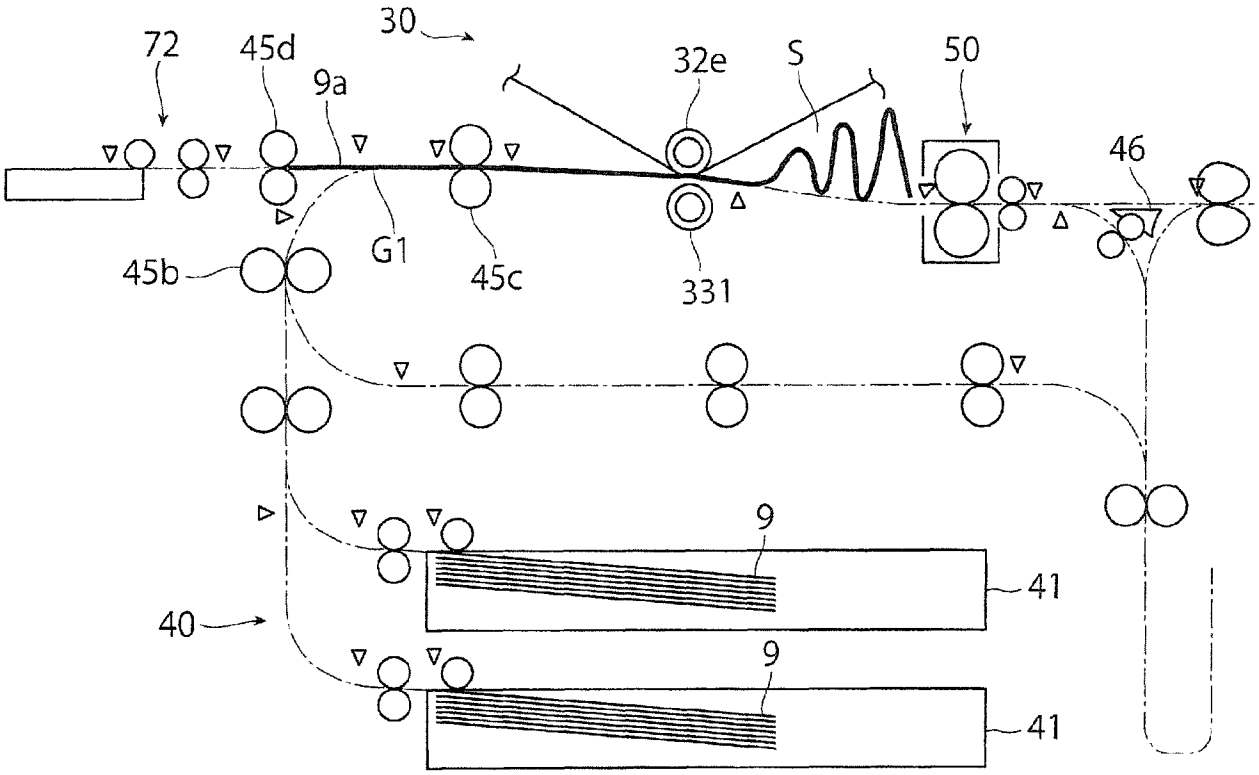
FIG. 10 illustrates a state in which a transport failure of long-length paper is caused.

At this time, as illustrated in FIG. 10, after the rear end of the long-length paper 9*a* passes through the paper transport roller pair 45*d* when the long-length paper 9*a* is transported to be fed to the feeding position S by the paper transport roller pair 45*c* and the paper transport roller pair 45*d*, only the paper transport roller pair 45*c* applies a transport force to feed the long-length paper 9*a* to the feeding position S. In that event, the distal end of the long-length paper 9*a* which is fed to the feeding position S is deformed into a bellows shape. The long-length paper 9*a* is long along the direction of transport compared to the regular recording paper 9, and imposes a large transport load. Therefore, the long-length paper 9*a* may not be reliably fed to the feeding position S by only the transport force of the paper transport roller pair 45*c*, and the rear end of the long-length paper 9*a* may remain on the other side of the merging position G1.

In the image forming apparatus 1, after operation to feed the long-length paper 9*a* to the feeding position S is executed, the user performs an operation to open the front cover 10*a* and draw out the paper transport unit 80 toward the front side of the apparatus body 10 as illustrated in FIGS. 7A and 7B, and performs an operation to remove the long-length paper 9*a*, which has been subjected to the transport failure, from the paper transport unit 80.

At this time, in the case where the long-length paper 9*a* is not reliably fed to the feeding position S, the rear end of the long-length paper 9*a* may remain on the other side of the merging position G1 as illustrated in FIG. 10, and the long-length paper 9*a* may be torn at the merging position G1 and remain on the side of the apparatus body 10 when the paper transport unit 80 is drawn out of the apparatus body 10.

Thus, as illustrated in FIG. 4, the image forming apparatus according to the exemplary embodiment includes a first drive motor 48*a* that serves as an example of a drive unit that rotationally drives the second transfer roller 331, which is positioned upstream of the fixing device 50, in contact with the intermediate transfer belt 31 in order to transport the long-length paper 9*a* to be fed to the feeding position S, which is determined in advance, using the paper transport roller pair 45*c* and the paper transport roller pair 45*d*.

The first drive motor 48*a* may be an individual drive motor. In the first exemplary embodiment, however, a principal motor of the image forming apparatus 1 is used as an example of the drive unit which rotationally drives the first drive motor 48*a*. The first drive motor 48*a* not only rotationally drives the second transfer roller 331 but also rotationally drives the photosensitive drum 21 etc. of the image preparing devices 20 (Y, M, C, K) for yellow (Y), magenta (M), cyan (C), and black (K), and also functions as a retract motor that drives a retract unit that causes the second transfer roller 331 to contact the belt support roller 32*c* and separates the second transfer roller 331 from the belt support roller 32*c*.

The image forming apparatus 1 includes a second drive motor 48*b* that serves as a retract motor that causes the first transfer device 25 of the image preparing devices 20 (Y, M, C, K) for yellow (Y), magenta (M), cyan (C), and black (K) to contact the photosensitive drum 21 and separates the first transfer device 25 from the photosensitive drum 21. The image forming apparatus 1 also includes a retract sensor 47*q* that detects that the first transfer device 25 is separated from the photosensitive drum 21.

The image forming apparatus 1 according to the first exemplary embodiment further includes a third drive motor 48*c* that serves as a belt drive motor that rotationally drives the intermediate transfer belt 31.

The image forming apparatus 1 is further provided with a retract clutch CL that transfers a rotational drive force of the first drive motor 48*a* to the retract unit which separates the second transfer roller 331 from the intermediate transfer belt 31.

The image forming apparatus 1 is also provided with a fourth drive motor 48*d* that serves as a resist motor that rotationally drives the paper transport roller pair 45*c* which functions as resistor rollers.

In transporting the long-length paper 9*a* to be fed to the feeding position S, the second transfer roller 331 is nipped by the belt support roller 32*c* via the intermediate transfer belt 31. In addition, the second transfer roller 331 does not perform second transfer operation, and therefore a second transfer bias is not applied to the support roller 32*c*.

In the exemplary embodiment, in addition, when a transport failure of the recording paper 9 including the long-length paper 9*a* is caused, the belt support roller 32*a* which functions as a drive roller for the intermediate transfer device 30 is driven to rotate the intermediate transfer belt 31 in accordance with the position at which the transport failure of the recording paper 9 is caused.

<Operation of Image Forming Apparatus>

In the image forming apparatus 1 according to the first exemplary embodiment, when a transport failure of the recording paper 9 is caused, operation to resolve the transport failure in accordance with the type and the transport position of the recording paper 9 is performed as follows.

In the case where an image is formed on the long-length paper 9*a* in the image forming apparatus 1, as illustrated in FIG. 1, the long-length paper 9*a* is placed on the manual feed tray 71 of the manual paper feed device 70, the input portion 14*a* of the operation display device 14 is operated to select the long-length paper 9*a* as the recording medium and select the manual paper feed device 70 as the paper feed device, and thereafter image forming operation is started.

As the image forming apparatus 1 starts the image forming operation, the long-length paper 9*a* is fed using the manual paper feed device 70, and transported to the second transfer position of the intermediate transfer device 30 via the paper transport roller pair 45*d* and the paper transport roller pair 45*c*. Then, after toner images formed on the intermediate transfer belt 31 are transferred through a second transfer onto the long-length paper 9*a* by the second transfer roller 331, the long-length paper 9*a* is subjected to a fixation process performed by the fixing device 50, and discharged to the discharge storage portion 12.

At this time, in the image forming apparatus 1, as illustrated in FIG. 9, for example, a transport failure of the long-length paper 9*a* is occasionally caused at the time when the distal end of the long-length paper 9*a* reaches a position upstream of the fixing device 50 along the direction of transport when the long-length paper 9*a* is transported from the auxiliary supply transport path Rt1' to the relay transport path Rt2 via the supply transport path Rt1.

Figure 11:
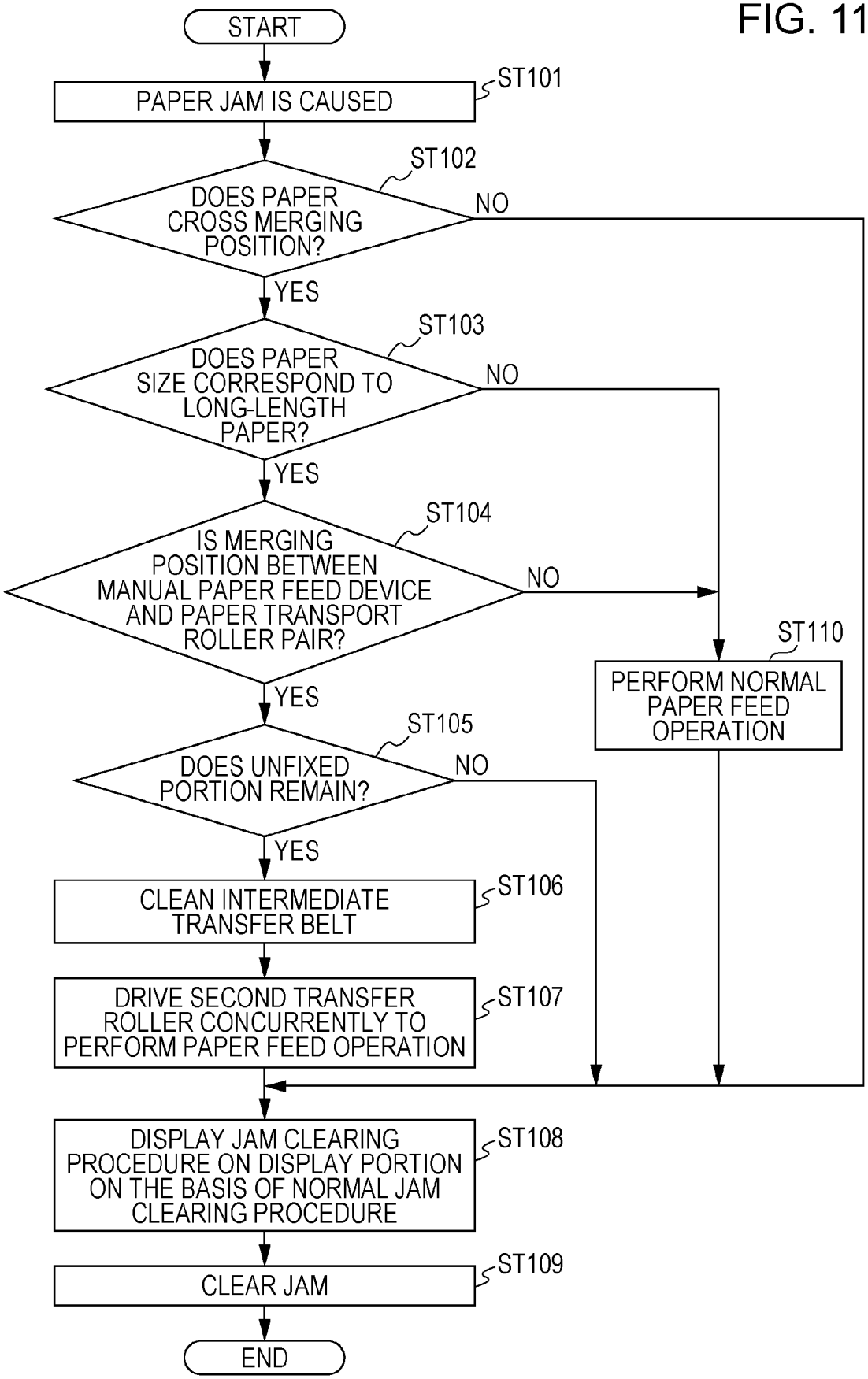
FIG. 11 is a flowchart illustrating operation to remove recording paper that has been subjected to a transport failure in the image forming apparatus according to the first exemplary embodiment of the present disclosure.

The control portion 101 of the control device 100 illustrated in FIG. 5 detects that a transport failure of the long-length paper 9*a* is caused if a signal for detection of the distal end of the long-length paper 9*a* is not input within a time determined in advance, as illustrated in FIG. 11, since supply of the long-length paper 9*a* from the manual paper feed device 70 is started on the basis of detection signals output from the first to sixteenth paper sensors 47*a* to 47*p* (step 101).

The control portion 101 specifies the position at which the transport failure of the recording paper 9 including the long-length paper 9*a* is caused by determining a detection signal from which of the first to sixteenth paper sensors 47*a* to 47*p* is not input.

In that event, the control portion 101 specifies the position at which the transport failure of the long-length paper 9*a* is caused by determining a detection signal from which of the first to sixteenth paper sensors 47*a* to 47*p* is not input, and determines whether or not the recording paper 9 which has been subjected to the transport failure crosses the merging position G1 or G2 (step 102).

If it is determined that the recording paper 9 which has been subjected to the transport failure does not cross the merging position G1 or G2, the control portion 101 displays a jam clearing procedure on the display portion 14*b* of the operation display device 14 on the basis of the normal jam clearing procedure (step 108).

After that, the user removes the recording paper 9 which has been subjected to the transport failure in accordance with the normal jam clearing procedure which is displayed on the display portion 14*b* of the operation display device 14 (step 109), and ends the process of removing the recording paper 9 which has been subjected to the transport failure.

If it is determined that the recording paper 9 which has been subjected to the transport failure crosses the merging position G1 or G2, on the other hand, the control portion 101 determines whether or not the size of the recording paper 9 corresponds to the long-length paper 9*a* (step 103).

If it is determined that the size of the recording paper 9 does not correspond to the long-length paper 9*a*, the control portion 101 performs operation to feed the normal recording paper 9 (step 110), and displays a jam clearing procedure on the display portion 14*b* of the operation display device 14 on the basis of the normal jam clearing procedure (step 108).

The operation to feed the normal recording paper 9 is operation to feed the recording paper 9 to the feeding position S by driving the paper transport roller pair 45*c*, or to feed the recording paper 9 by driving the fixing device 50, the discharge roller pair 45*e*, the lead-in path 45*f*, etc.

Then, the user removes the recording paper 9 which has been subjected to the transport failure in accordance with the normal jam clearing procedure which is displayed on the display portion 14*b* of the display device 14 (step 109), and ends the process of removing the recording paper 9 which has been subjected to the transport failure.

If it is determined that the size of the recording paper 9 corresponds to the long-length paper 9*a*, in contrast, the control portion 101 determines whether or not the merging position which is crossed by the long-length paper 9*a* is the merging position G1 which is positioned between the manual paper feed device 70 and the paper transport roller pair 45*c* (step 104).

If it is determined that the merging position which is crossed by the long-length paper 9*a* is not the merging position G1 which is positioned between the manual paper feed device 70 and the paper transport roller pair 45*c*, the control portion 101 performs operation to feed the normal recording paper (step 110), and thereafter displays a jam clearing procedure on the display portion 14*b* of the operation display device 14 on the basis of the normal jam clearing procedure (step 108). When the user removes the long-length paper 9*a* which has been subjected to the transport failure in accordance with the normal jam clearing procedure which is displayed on the display portion 14*b* of the display device 14 (step 109), the process of removing the long-length paper 9*a* which has been subjected to the transport failure is ended.

If it is determined that the merging position which is crossed by the long-length paper 9*a* is the merging position G1 which is positioned between the manual paper feed device 70 and the paper transport roller pair 45*c*, on the other hand, the control portion 101 determines whether or not an unfixed toner image remains on the long-length paper 9*a* (step 105).

Figure 12:
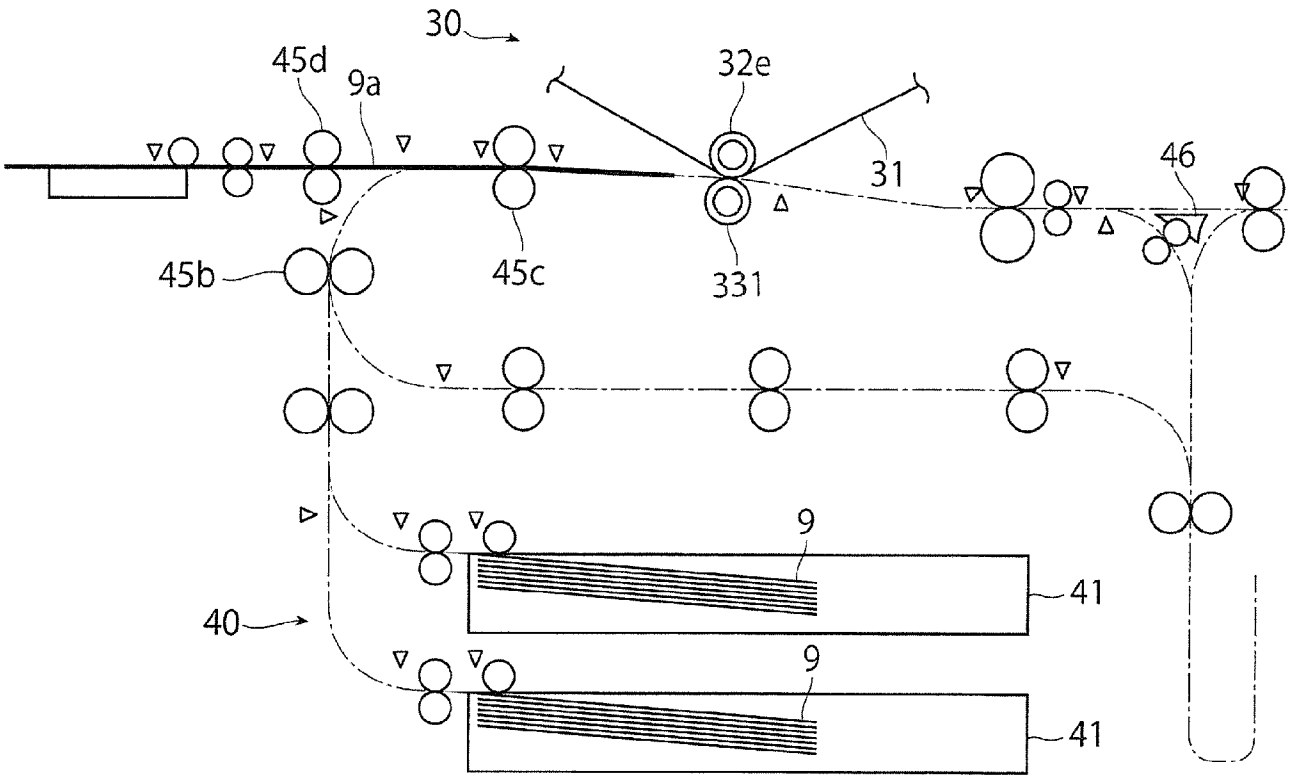
FIG. 12 illustrates a state in which a transport failure of long-length paper is caused.

In the case where the merging position which is crossed by the long-length paper 9*a* is the merging position G1 which is positioned between the manual paper feed device 70 and the paper transport roller pair 45*c* and an unfixed toner image does not remain on the long-length paper 9*a*, the distal end of the long-length paper 9*a* is positioned upstream of the second transfer position of the intermediate transfer device 30 as illustrated in FIG. 12.

If it is determined that an unfixed toner image does not remain on the long-length paper 9*a*, the control portion 101 displays a jam clearing procedure on the display portion 14*b* of the operation display device 14 on the basis of the normal jam clearing procedure (step 108) without performing operation to push the long-length paper 9*a*. When the user removes the long-length paper 9*a* which has been subjected to the transport failure in accordance with the normal jam clearing procedure which is displayed on the display portion 14*b* of the display device 14 (step 109), the removal process is ended.

The normal jam clearing procedure refers to an operation of removing the long-length paper 9*a* which has been subjected to a transport failure by the user grasping the rear-end portion of the long-length paper 9*a* along the direction of transport with his/her hand and pulling the long-length paper 9*a* from the side of the manual paper feed device 70 to the outside of the apparatus body 10. In this case, an unfixed toner image does not remain on the long-length paper 9*a*, and therefore there is no possibility that an unfixed toner image on the long-length paper 9*a* soils the paper transport roller pair 45*c* or 45*d* or the feeding device 72 even if an operation of removing the long-length paper 9*a* by pulling the long-length paper 9*a* to the outside of the apparatus body 10 is performed.

If it is determined that there remains an unfixed toner image on the long-length paper 9*a* as illustrated in FIG. 9, in contrast, the control portion 101 executes operation to clean the intermediate transfer belt 31 (step 106).

The control portion 101 executes operation in which the belt cleaning device 34 cleans an untransferred toner image that remains on the intermediate transfer belt 31 by driving the support roller 32*a* of the intermediate transfer device 30. At this time, the second transfer roller 331 is moved to a position away from the intermediate transfer belt 31. However, the second transfer roller 331 may be kept in contact with the intermediate transfer belt 31.

Figure 13:
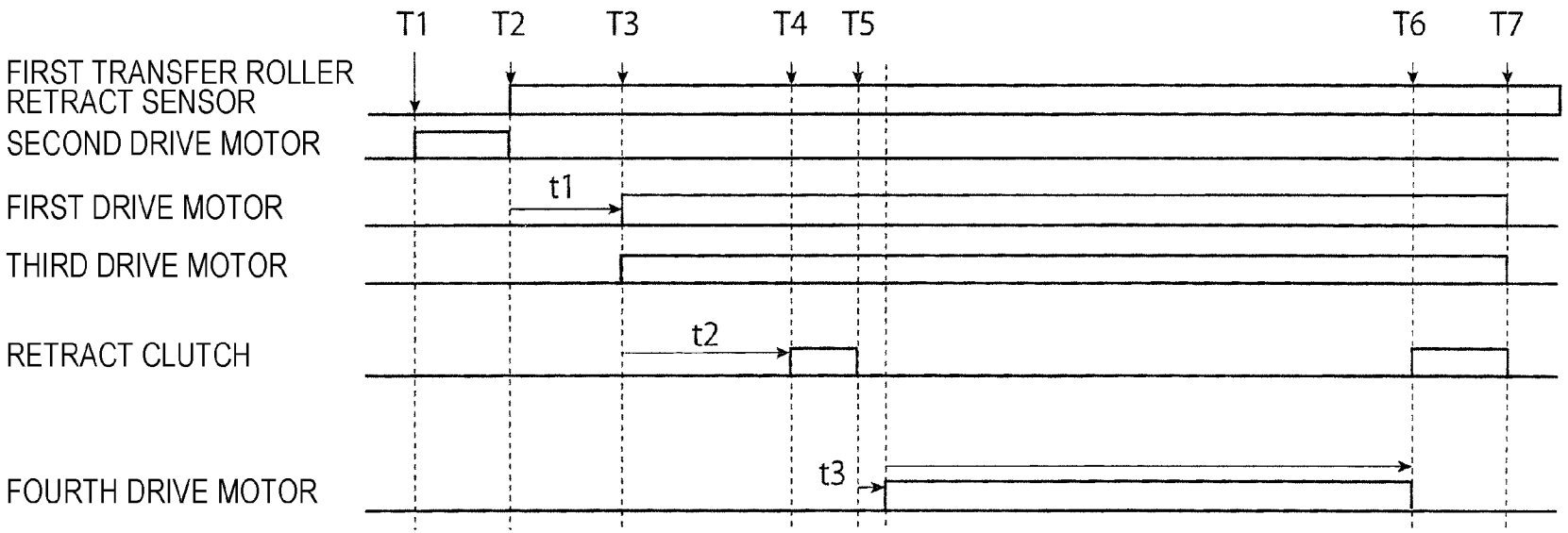
FIG. 13 is a timing chart illustrating operation to remove recording paper that has been subjected to a transport failure in the image forming apparatus according to the first exemplary embodiment of the present disclosure.

After that, the control portion 101 rotationally drives the second drive motor 48*b* at timing T1 for a time determined in advance as illustrated in FIG. 13 to move the first transfer device 25 for yellow (Y), magenta (M), cyan (C), and black (K) to a retracted position separated from the photosensitive drum 21. Movement of the first transfer device 25 to the retracted position is detected by the retract sensor 47*q*.

Figure 14:
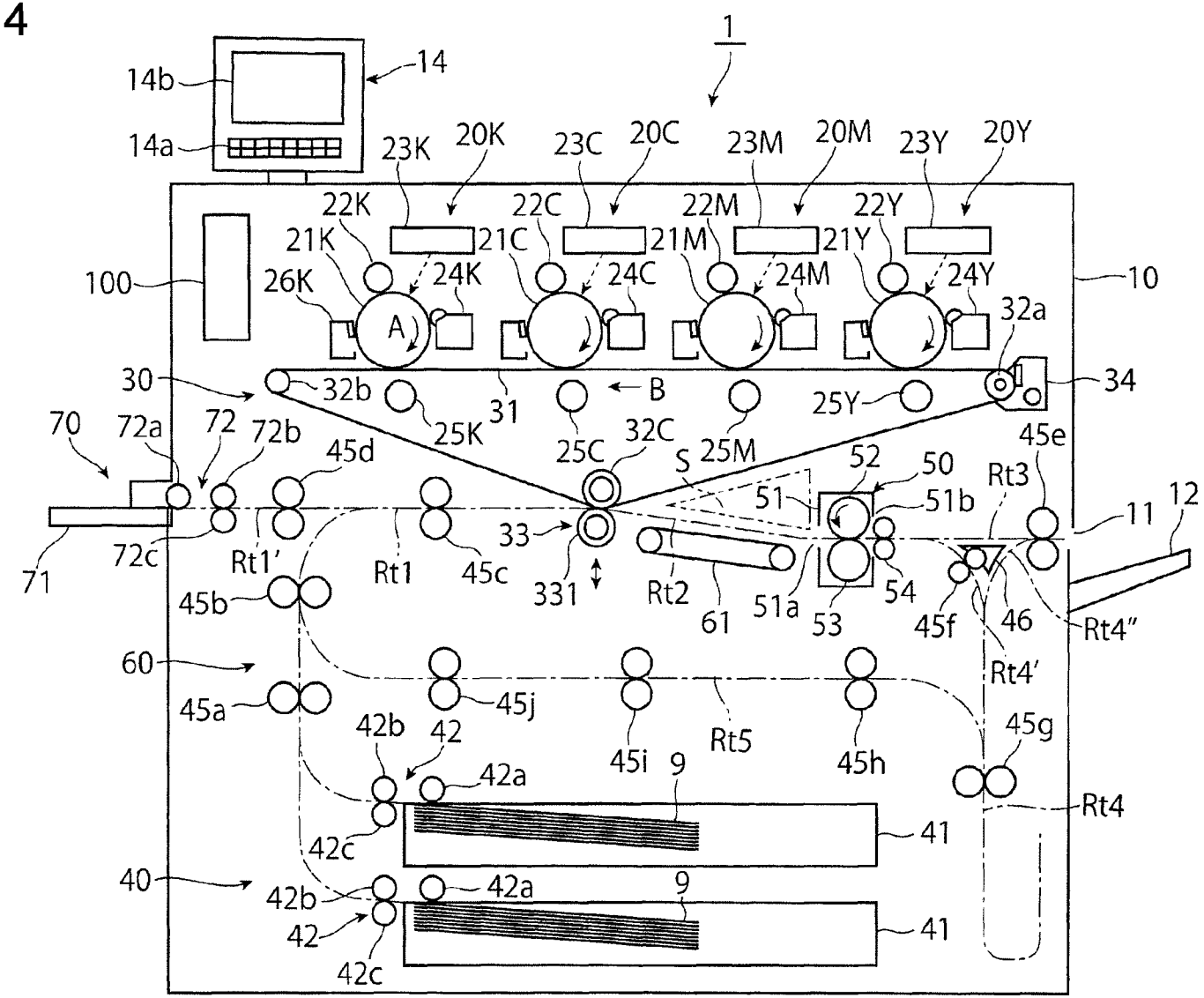
FIG. 14 is a diagram illustrating operation to remove recording paper that has been subjected to a transport failure in the image forming apparatus according to the first exemplary embodiment of the present disclosure.
Figure 15:
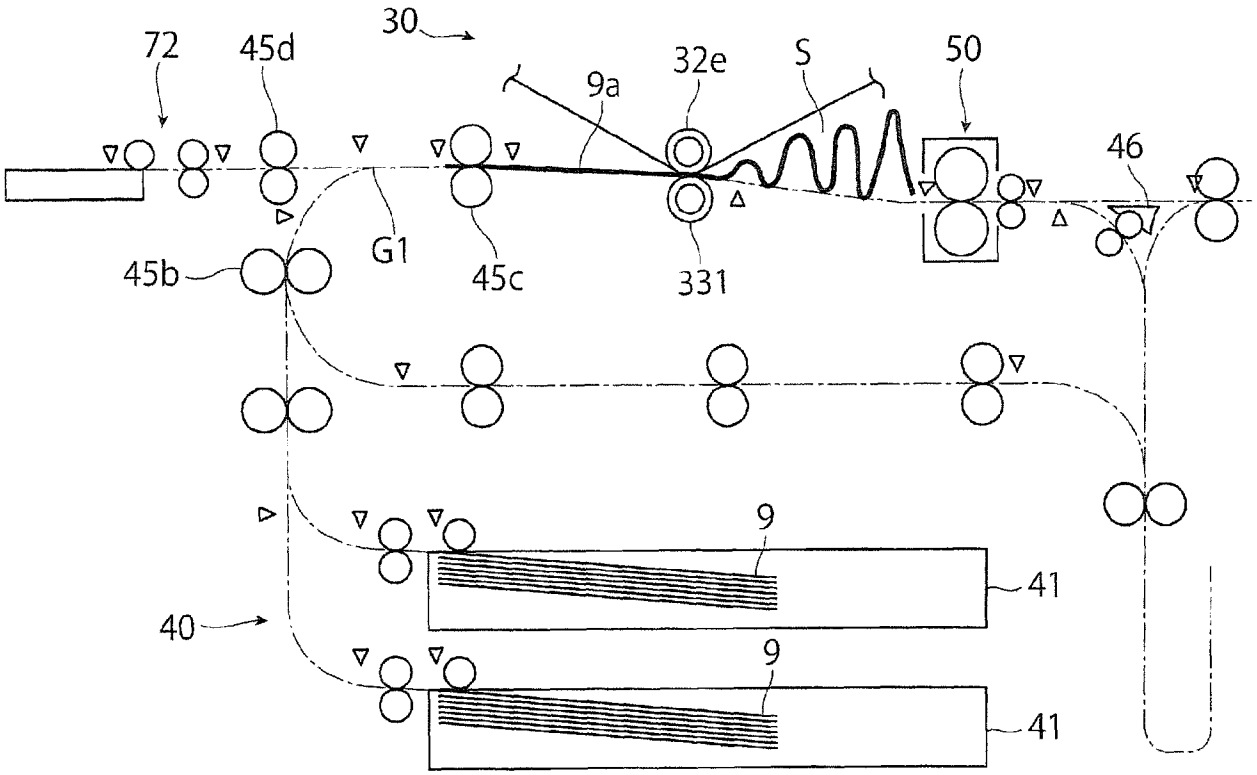
FIG. 15 illustrates a state in which a transport failure of long-length paper is caused.

As illustrated in FIG. 14, when movement of the first transfer device 25 to the retracted position is detected by the retract sensor 47*q*, the control portion 101 drives the first drive motor 48*a* and the third drive motor 48*c* after the lapse of a prescribed time t1 (T3) to rotationally drive the photosensitive drum 21 for yellow (Y), magenta (M), cyan (C), and black (K) and the intermediate transfer belt 31.

After that, the control portion 101 turns on the retract clutch CL at timing T4, at which a prescribed time t2 has lapsed, to cause the second transfer roller 331 to contact the intermediate transfer belt 31 which is rotationally driven. At this time, the second transfer roller 331 is also rotationally driven by the first drive motor 48*a*.

After that, the control portion 101 drives the fourth drive motor 48*d* for a time determined in advance after the lapse of a prescribed time t3 to perform operation to feed the long-length paper 9*a* to the feeding position S using the paper transport roller pair 45*c* in addition to the second transfer roller 331 (step 107).

After the paper transport roller pair 45*c* is driven for a prescribed time, the control portion 101 turns on the retract clutch CL again to separate the second transfer roller 331 from the intermediate transfer belt 31. When the separating operation is ended, the first and third drive motors are stopped. At this time, the first transfer device 25 is kept separated from the photosensitive drum 21.

In this manner, in the first exemplary embodiment described above, when operation to feed the long-length paper 9*a* to the feeding position S is performed, the paper transport roller pair 45*c* and the second transfer roller 331 are driven concurrently with the photosensitive drum 21 and the intermediate transfer belt 31 driven. Therefore, the long-length paper 9*a* is reliably fed to a position at which the rear end of the long-length paper 9*a* has passed through the merging position G1. In the operation to feed the long-length paper 9*a*, it is not necessary that all the long-length paper 9*a* should be fed to the feeding position S, and it is only necessary that the long-length paper 9*a* should be fed to a position at which the rear end of the long-length paper 9*a* has reliably passed through the merging position G1.

After that, the control portion 101 displays a jam clearing procedure on the display portion 14*b* of the operation display device 14 on the basis of the normal jam clearing procedure (step 108). When the user removes the long-length paper 9*a* which has been subjected to the transport failure in accordance with the normal jam clearing procedure which is displayed on the display portion 14*b* of the display device 14 (step 109), the removal process is ended.

Figure 16A:
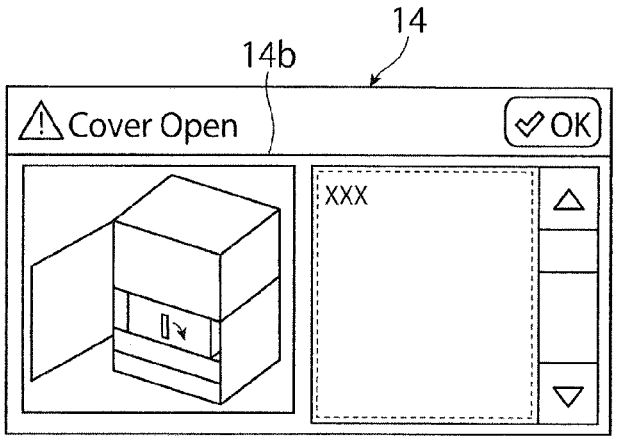
FIGS. 16A to 16C illustrate the procedure of removing the recording paper which has been subjected to a transport failure.
Figure 16B:
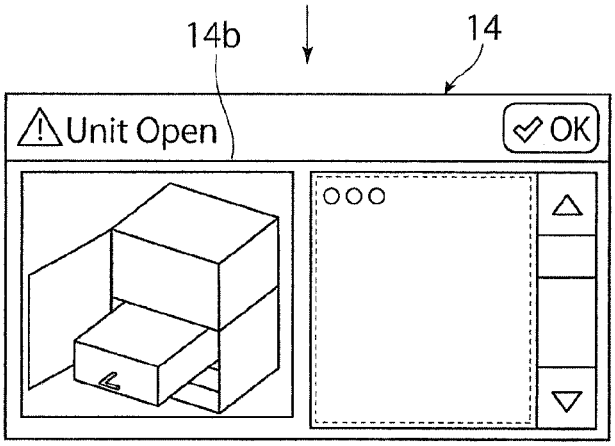
Figure 16C:
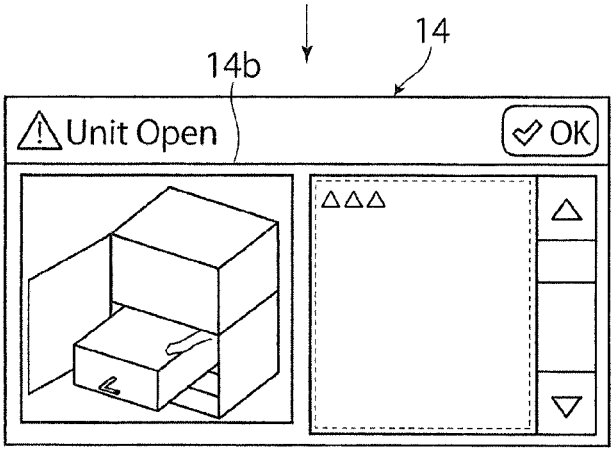

The normal jam clearing procedure prompts the user, on the display portion 14*b* of the operation display device 14 as illustrated in FIG. 16, to open the front cover 10*a* of the image forming apparatus 1, thereafter unlock the paper transport unit 80 by operating the operation lever 81 of the paper transport unit 80, draw out the paper transport unit 80 toward the front surface side of the apparatus body 10, and remove the long-length paper 9*a* which has been pushed into the feeding position S from the paper transport unit 80.

Figure 17:
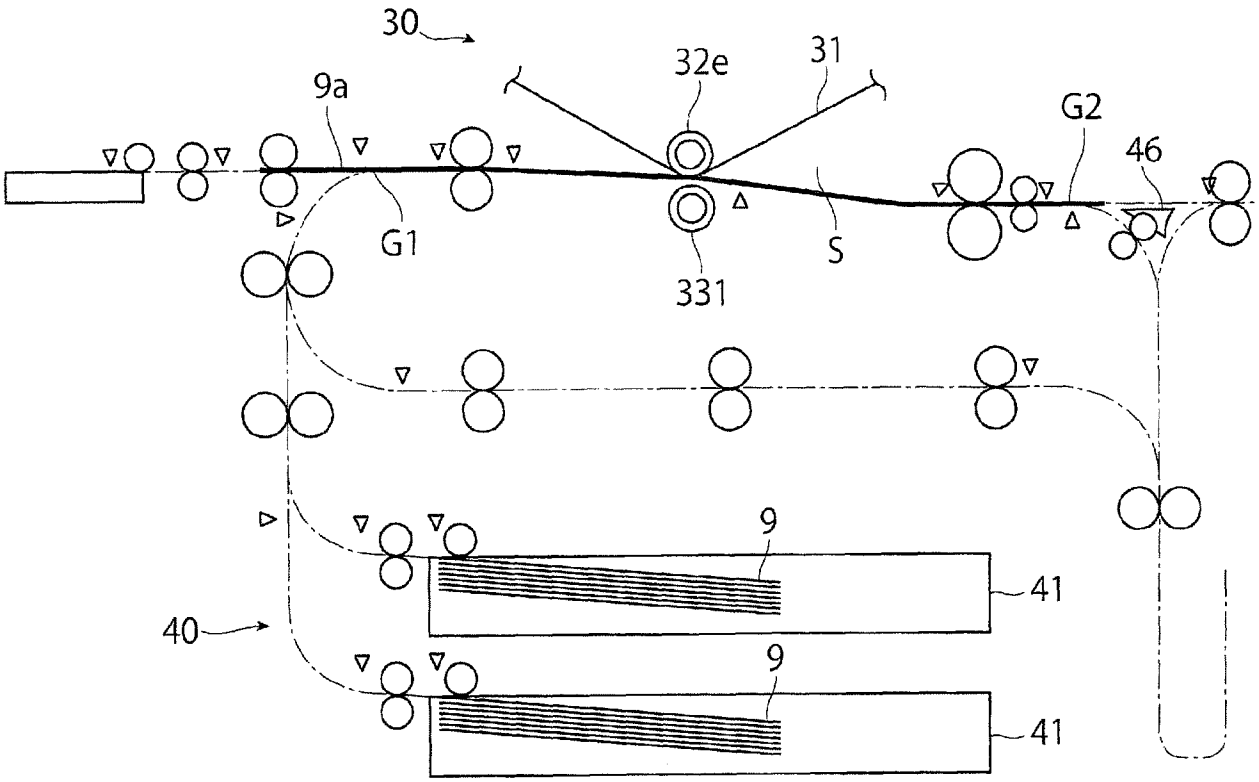
FIG. 17 illustrates a state in which a transport failure of long-length paper is caused.
Figure 18:
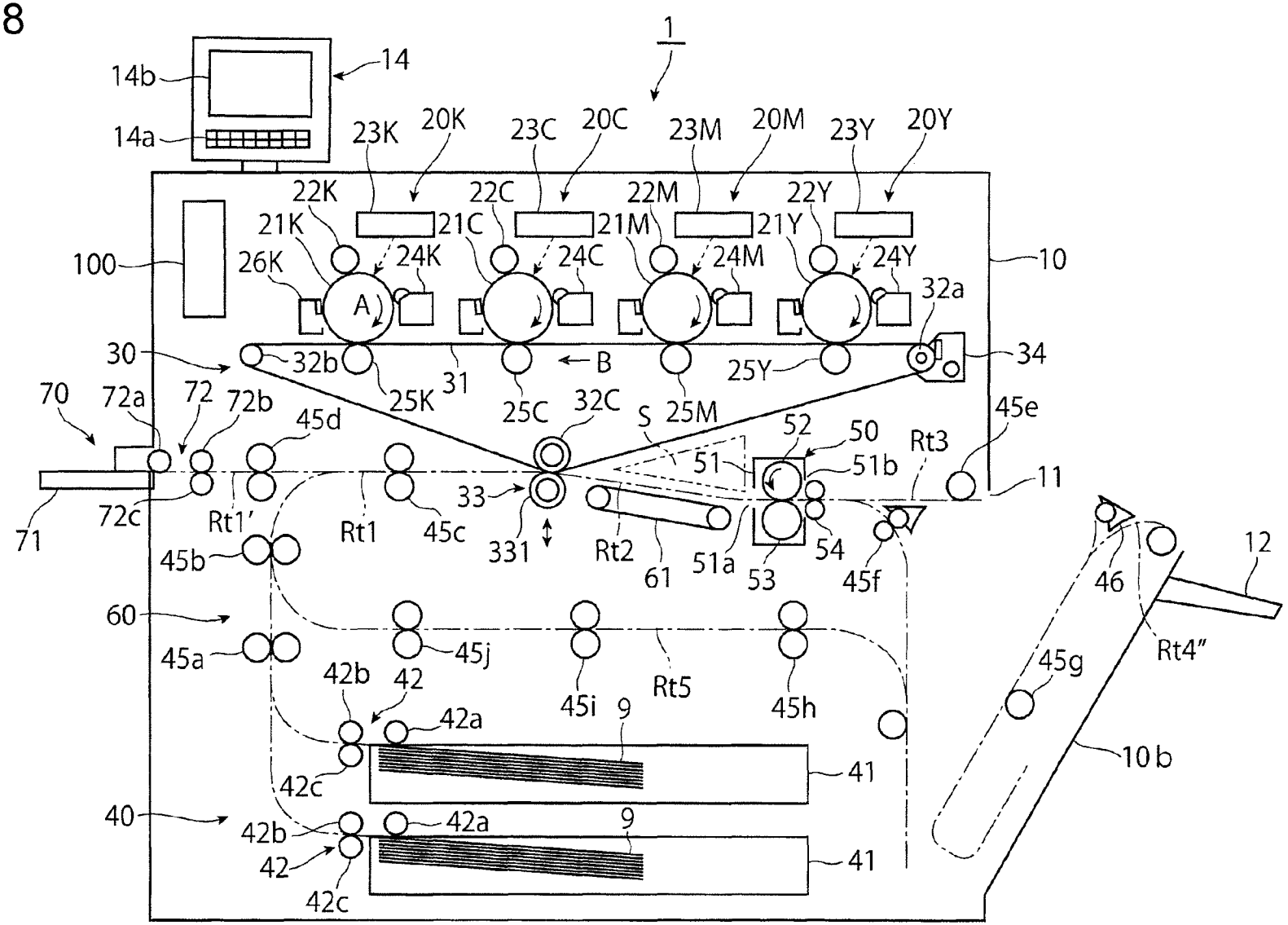
FIG. 18 is a diagram illustrating operation to remove the recording paper which has been subjected to a transport failure.

In the case where a transport failure is caused at a position at which the distal end of the long-length paper 9*a* has passed beyond the merging position G2 as illustrated in FIG. 17, meanwhile, operation to remove the long-length paper 9*a* is performed with a side cover 10*b* positioned on the right side surface of the image forming apparatus 1 opened, as illustrated in FIG. 18, with the recording paper 9 not nipped by the heating rotary member 52 and the pressurizing rotary member 53 of the fixing device 50 and the exit roller 54. At this time, in the image forming apparatus 1, it is only necessary to release nipping by the second transfer roller 331 and the fixing device 50, and it is not necessary to retract the first transfer device 25 or drive the intermediate transfer belt 31.

In the exemplary embodiment, in addition, when the recording paper 9 which is the long-length paper 9*a* is fed to the feeding position S, the intermediate transfer belt 31 is rotationally driven with the first transfer device 25 separated (retracted) from the photosensitive drum 21.

Second Exemplary Embodiment

Figure 19:
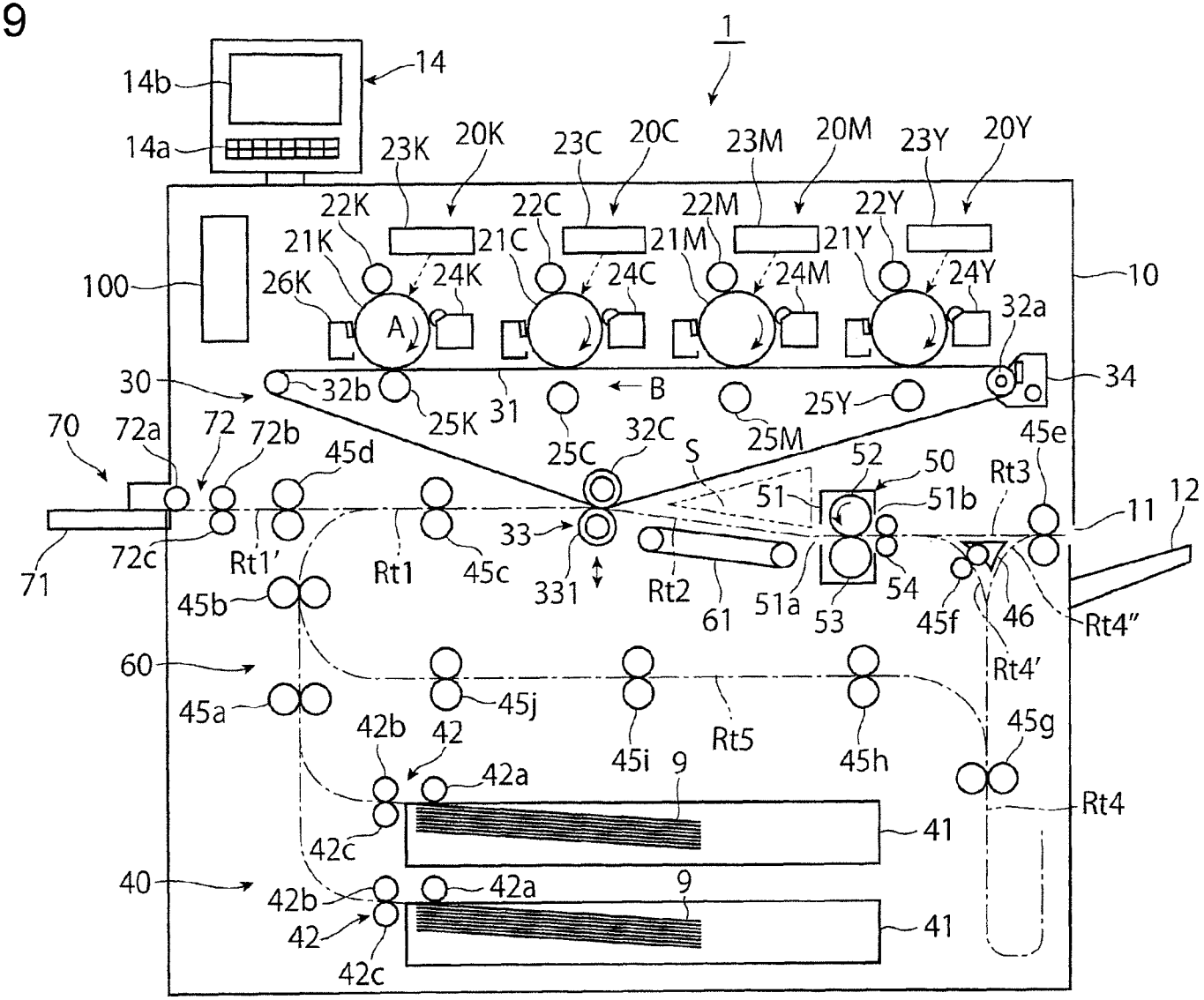
FIG. 19 is a schematic diagram illustrating an image forming apparatus according to a second exemplary embodiment of the present disclosure.

FIG. 19 illustrates an image forming apparatus according to a second exemplary embodiment. In the second exemplary embodiment, an image holding unit that is the closest to the upstream side of the second transfer unit along the direction of movement of the intermediate transfer unit, among the plurality of image holding units, includes an individual drive unit. When the recording medium which has been subjected to a transport failure is transported to the feeding position by the first transport unit, the first transfer unit corresponding to the image holding unit which includes the individual drive unit is not separated from the intermediate transfer unit, and the image holding unit is driven by the individual drive unit.

Figure 20:
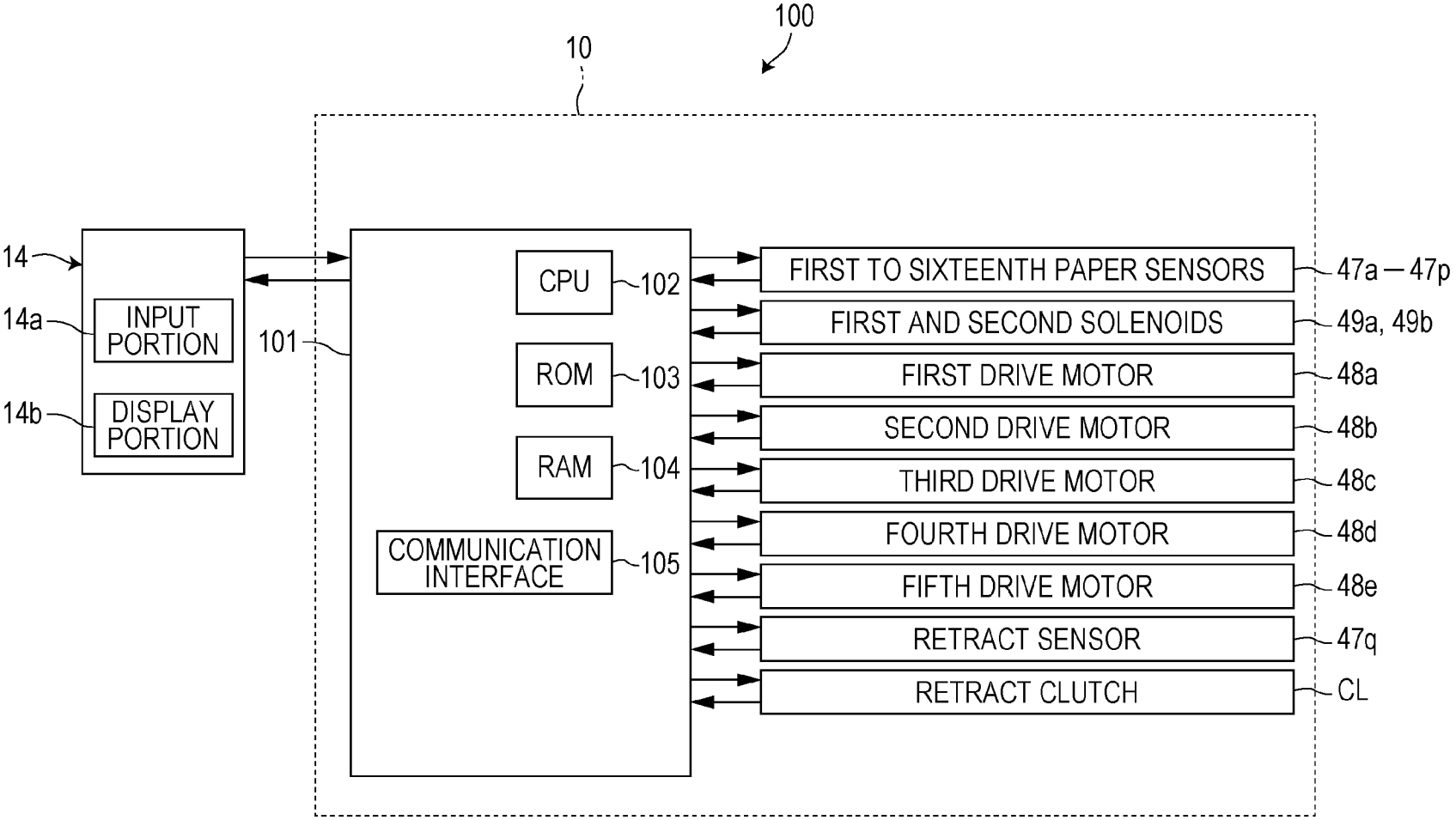
FIG. 20 is a block diagram illustrating a control device of the image forming apparatus according to the second exemplary embodiment of the present disclosure.

That is, in the second exemplary embodiment, as illustrated in FIG. 20, the image preparing device 20K for black (K) which is the closest to the second transfer position, among the image preparing devices 20 (Y, M, C, K) for yellow (Y), magenta (M), cyan (C), and black (K), includes an individual fifth drive motor 48*e* that is not the first drive motor 48*a* which serves as a principal motor.

In addition, in the image forming apparatus 1 according to the second exemplary embodiment, as illustrated in FIG. 19, the first transfer device 25 of the image preparing device 20K for black (K) is not retracted to a position away from the photosensitive drum 21, and is in contact with the photosensitive drum 21 via the intermediate transfer belt 31 at all times.

When a transport failure of the long-length paper 9*a* is caused at the time when the distal end of the long-length paper 9*a* reaches a position upstream of the fixing device 50 along the direction of transport during transport of the long-length paper 9*a* from the auxiliary supply transport path Rt1' to the relay transport path Rt2 via the supply transport path Rt1, the image forming apparatus 1 according to the second exemplary embodiment illustrated in FIG. 19 executes the following operation.

Figure 21:
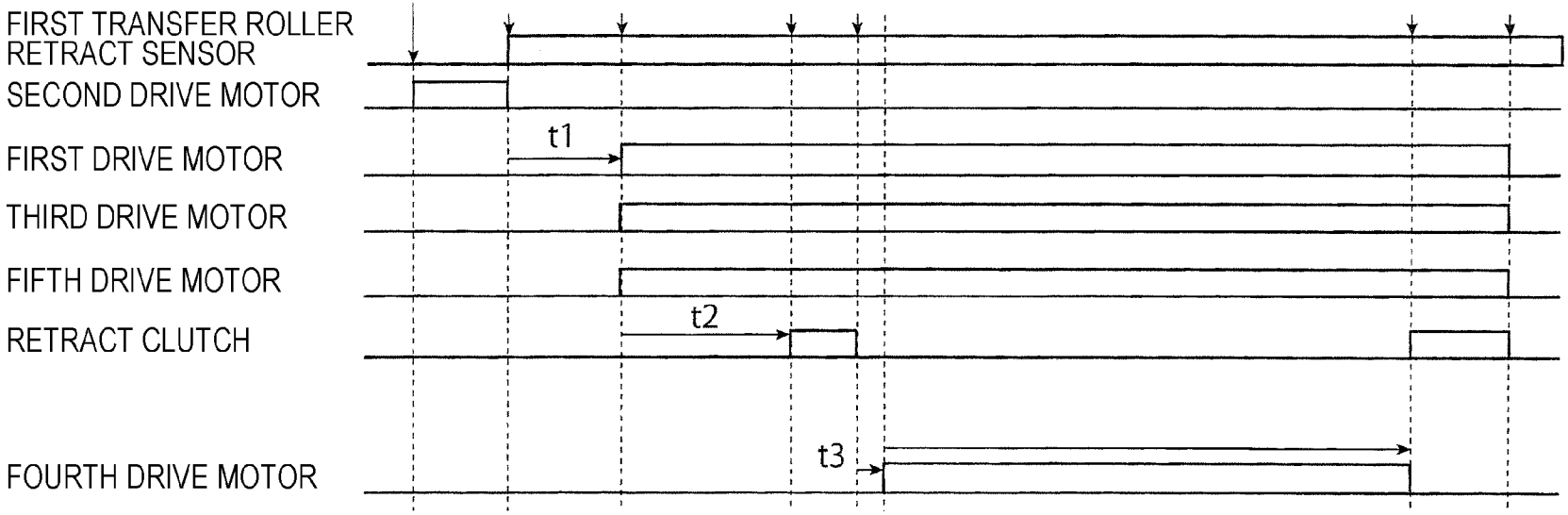
FIG. 21 illustrates the configuration of a part of the image forming apparatus according to the second exemplary embodiment of the present disclosure.

That is, in the second exemplary embodiment, as illustrated in FIG. 21, the control portion 101 rotationally drives the fifth drive motor 48*e* together with the first and third drive motors 48*a* and 48*c* with the first transfer device 25 separated from the photosensitive drum 21 in the image preparing devices 20 excluding the image preparing device 20K for black (K), among the image preparing devices 20 (Y, M, C, K) for yellow (Y), magenta (M), cyan (C), and black (K), and with the first transfer device 25 kept in contact with the photosensitive drum 21 in the image preparing device 20K for black (K).

In the exemplary embodiment described above, the second transfer unit is rotationally driven. However, the present disclosure is not limited thereto, and the second transfer unit may contact the intermediate transfer unit via the recording medium to be rotated in the following manner, rather than being rotationally driven.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a plurality of first transfer units that transfer an image formed on a plurality of image holding units to an intermediate transfer unit;

a second transfer unit that transfers the image, which is transferred to the intermediate transfer unit, to a recording medium;

a first transport unit that transports the recording medium to the second transfer unit; and a drive unit that drives the intermediate transfer unit with at least some of the plurality of first transfer units separated from the intermediate transfer unit and with the second transfer unit contacting the intermediate transfer unit when the recording medium, which has been subjected to a transport failure, is transported to a feeding position by the first transport unit, wherein the second transfer unit is separated from the intermediate transfer unit in a case where the recording medium, which has been subjected to the transport failure, is not transported to the feeding position by the first transport unit.

2. The image forming apparatus according to claim 1, wherein the second transfer unit rotates from contacting the intermediate transfer unit via the recording medium.

3. The image forming apparatus according to claim 1, wherein the second transfer unit is rotationally driven.

4. The image forming apparatus according to claim 3, wherein the second transfer unit is rotationally driven by a drive force transferred from a drive unit that is identical to or different from the drive unit.

5. The image forming apparatus according to claim 1, wherein the plurality of first transfer units and the second transfer unit are not rotationally driven in a case where the recording medium is not recording paper with a length ranging from 450 mm to 1200 mm.

6. An image forming apparatus comprising:

a plurality of first transfer units that transfer an image formed on a plurality of image holding units to an intermediate transfer unit;

a second transfer unit that transfers the image, which is transferred to the intermediate transfer unit, to a recording medium;

a first transport unit that transports the recording medium to the second transfer unit; and a drive unit that drives the intermediate transfer unit with the plurality of first transfer units and the second transfer unit contacting the intermediate transfer unit when the recording medium, which has been subjected to a transport failure, is transported to a feeding position by the first transport unit, wherein the second transfer unit is separated from the intermediate transfer unit in a case where the recording medium, which has been subjected to the transport failure, is not transported to the feeding position by the first transport unit.

7. The image forming apparatus according to claim 6, wherein the second transfer unit rotates from contacting the intermediate transfer unit via the recording medium.

8. The image forming apparatus according to claim 6, wherein the second transfer unit is rotationally driven.

9. The image forming apparatus according to claim 8, wherein the second transfer unit is rotationally driven by a drive force transferred from a drive unit that is identical to or different from the drive unit.

10. The image forming apparatus according to claim 6, further comprising:

a second transport unit disposed upstream of the first transport unit along a direction of transport of the recording medium to transport the recording medium; and an information providing unit that provides a user with information, wherein, when the transport failure is caused before a distal end of the recording medium reaches the second transfer unit, operation in which the first transport unit transports the recording medium to a feeding position is not executed, and the information providing unit provides the user with information that prompts the user to extract the recording medium from a side of the second transport unit.

11. The image forming apparatus according to claim 6, wherein the plurality of first transfer units and the second transfer unit are not rotationally driven in a case where the recording medium is not recording paper with a length ranging from 450 mm to 1200 mm.

12. An image forming apparatus comprising:

a plurality of first transfer units that transfer an image formed on a plurality of image holding units to an intermediate transfer unit;

a second transfer unit that transfers the image, which is transferred to the intermediate transfer unit, to a recording medium;

a first transport unit that transports the recording medium to the second transfer unit; and a drive unit that drives the intermediate transfer unit with at least some of the plurality of first transfer units separated from the intermediate transfer unit and with the second transfer unit contacting the intermediate transfer unit when the recording medium, which has been subjected to a transport failure, is transported to a feeding position by the first transport unit, wherein the image holding unit that is closest to an upstream side of the second transfer unit along a direction of movement of the intermediate transfer unit, among the plurality of image holding units, includes an individual drive unit, and the image holding unit is driven by the individual drive unit with the first transfer unit corresponding to the image holding unit which includes the individual drive unit not separated from the intermediate transfer unit when the recording medium, which has been subjected to the transport failure, is transported to the feeding position by the first transport unit.

13. An image forming apparatus comprising:

a plurality of first transfer units that transfer an image formed on a plurality of image holding units to an intermediate transfer unit;

a second transfer unit that transfers the image, which s transferred to the intermediate transfer unit, to a recording medium;

a first transport unit that transports the recording medium to the second transfer unit; and a drive unit that drives the intermediate transfer unit with the plurality of first transfer units and the second transfer unit contacting the intermediate transfer unit when the recording medium, which has been subjected to a transport failure, is transported to a feeding position by the first transport unit, wherein the image holding unit that is closest to an upstream side of the second transfer unit along a direction of movement of the intermediate transfer unit, among the plurality of image holding units, includes an individual drive unit, and the image holding unit is driven by the individual drive unit with the first transfer unit corresponding to the image holding unit which includes the individual drive unit not separated from the intermediate transfer unit when the recording medium, which has been subjected to the transport failure, is transported to the feeding position by the first transport unit.

14. An image forming apparatus comprising:

a plurality of first transfer units that transfer an image formed on a plurality of image holding units to an intermediate transfer unit;

a second transfer unit that transfers the image, which is transferred to the intermediate transfer unit, to a recording medium;

a first transport unit that transports the recording medium to the second transfer unit; and a drive unit that drives the intermediate transfer unit with at least some of the plurality of first transfer units separated from the intermediate transfer unit and with the second transfer unit contacting the intermediate transfer unit when the recording medium, which has been subjected to a transport failure, is transported to a feeding position by the first transport unit, wherein the image forming apparatus further comprising:

a second transport unit disposed upstream of the first transport unit along a direction of transport of the recording medium to transport the recording medium; and an information providing unit that provides a user with information, wherein, when the transport failure is caused before a distal end of the recording medium reaches the second transfer unit, operation in which the first transport unit transports the recording medium to a feeding position is not executed, and the information providing unit provides the user with information that prompts the user to extract the recording medium from a side of the second transport unit.

* * * * *